US010301822B2

(12) United States Patent
Yang

(10) Patent No.: US 10,301,822 B2
(45) Date of Patent: May 28, 2019

(54) WALL AND CONSTRUCTION METHOD FOR SAME

(71) Applicant: DONGGUAN SHIXI INTELLIGENT MACHINE MANUFACTURING CO. LTD., Dongguan (CN)

(72) Inventor: Dongzuo Yang, Dongguan (CN)

(73) Assignee: DONGGUAN SHIXI INTELLIGENT MACHINE MANUFACTURING CO. LTD., Dongguan (CN)

( * ) Notice: Subject to any disclaimer, the term of this patent is extended or adjusted under 35 U.S.C. 154(b) by 0 days.

(21) Appl. No.: 15/564,081

(22) PCT Filed: Mar. 5, 2014

(86) PCT No.: PCT/CN2014/072921
§ 371 (c)(1),
(2) Date: Oct. 3, 2017

(87) PCT Pub. No.: WO2015/131354
PCT Pub. Date: Sep. 11, 2015

(65) Prior Publication Data

US 2018/0202154 A1 Jul. 19, 2018

(51) Int. Cl.
*E04B 2/90* (2006.01)

(52) U.S. Cl.
CPC ..... *E04B 2/90* (2013.01)

(58) Field of Classification Search
CPC ... E04B 2/96; E04B 2/88; E04B 2/967; E04B 2/885; E04B 2/90
USPC ..... 52/235, 284, 395, 463–468, 475.1, 476, 52/764, 772, 506.06
See application file for complete search history.

(56) References Cited

U.S. PATENT DOCUMENTS 2,052,229 A * 8/1936 Hyde ..... C03C 27/06 156/332
2,199,244 A * 4/1940 Mulford ..... E04B 5/46 404/22
2,996,845 A * 8/1961 Cipriani ..... E04B 2/90 52/395
3,038,568 A * 6/1962 Morgan ..... E04B 2/90 52/204.7

(Continued)

*Primary Examiner* — Brian E Glessner
*Assistant Examiner* — Adam G Barlow
(74) *Attorney, Agent, or Firm* — WPAT, PC

(57) ABSTRACT

The present invention discloses a wall and a construction method. The wall comprises keel frames comprising transverse keels and longitudinal keels, cells are formed between adjacent transverse keels and adjacent longitudinal keels; each panel unit is installed in each cell; each panel unit is installed in each cell; transverse mounting strips are arranged between the transverse keels and the panel units, and longitudinal mounting strips are arranged between the longitudinal keels and the panel units; the transverse mounting strip stretches across the transverse keel, the longitudinal mounting strip stretches across the longitudinal keel; outdoor and indoor position corresponding to the transverse keel is provided with a transverse outer trim strip and a transverse inner trim strip; outdoor and indoor position corresponding to the longitudinal keel is provided with a longitudinal outer trim strip and a longitudinal inner trim strip. The present invention can better protect the keel frames, and easy to form a wall.

24 Claims, 16 Drawing Sheets

(56) References Cited

U.S. PATENT DOCUMENTS 3,180,780 A * 4/1965 Ritter ..... E04B 2/90 428/180
3,715,848 A * 2/1973 Jordan ..... E04B 1/62 52/202
5,448,864 A * 9/1995 Rosamond ..... E04O 2/546 52/307
5,992,111 A * 11/1999 Waterhouse ..... E04O 2/546 52/203
7,043,885 B2 * 5/2006 LeMert ..... E04O 2/546 52/308
7,134,247 B2 * 11/2006 Ting ..... E06B 3/4609 52/235
7,373,763 B2 * 5/2008 Voegele, Jr. ..... E04C 1/42 52/223.7
7,587,870 B2 * 9/2009 Voegele, Jr. ..... E04C 1/42 52/306
7,984,593 B2 * 7/2011 Weiser ..... E04F 13/12 52/235
8,683,764 B2 * 4/2014 Smith ..... E04C 1/42 52/235
8,991,121 B1 * 3/2015 Baker ..... E04B 2/90 52/235
2009/0229208 A1 * 9/2009 Spannbauer ..... E04B 2/90 52/393
2012/0124926 A1 * 5/2012 Kuo ..... E04C 1/42 52/306
2012/0180414 A1 * 7/2012 Burgess ..... E04B 2/90 52/300
2015/0284950 A1 * 10/2015 Stramandinoli ..... E04B 2/965 52/235
2015/0284951 A1 * 10/2015 Frederick ..... E04B 2/965 52/235
2016/0053487 A1 * 2/2016 Frederick ..... E04B 2/90 52/235
2017/0070185 A1 * 3/2017 Ting ..... E06B 1/00

* cited by examiner

WALL AND CONSTRUCTION METHOD FOR SAME

CROSS REFERENCE TO RELATED APPLICATIONS

This application is a national stage filing under section 371 of International Application No. PCT/CN2014/072921 filed on Mar. 5, 2014, and published in Chinese on Sep. 11, 2015 as WO 2015/131354.

TECHNICAL FIELD

The invention relates to a wall and a wall construction method.

BACKGROUND OF THE INVENTION

A wall is an important part of a building. It has the function of bearing, enveloping or separating space. A wall is divided by wall stress and material into bearing wall and non-bearing wall, and by wall construction mode into solid wall, sintered hollow brick wall, rowlock wall and composite wall. A curtain wall is an exterior wall envelope for buildings, which is not for load-bearing and hang up like a curtain, so it is also known as the suspended wall. The curtain wall is a common light weight wall with a decorative effect for large high-rise modern buildings. The existing curtain wall consists of a structural frame and inlaid panels as a building envelope not bearing the major structure loads and actions.

Most of the traditional walls and curtain walls are constructed separately. For example, a glass curtain wall structure is disclosed in the patent literature with Chinese application number 201110391691.9, application date Nov. 30, 2011 and publication date Jun. 13, 2012. It is specifically disclosed that all the operations are conducted outdoors, and the skeleton part of the curtain wall is formed by connection of insulated aluminum alloy vertical keel with insulated aluminum alloy horizontal keel and fixed to the major structure by connecting parts and embedded parts. Glass is fitted in the installation position formed by the skeleton part. For the curtain wall, the skeleton is fixed by the connecting parts and embedded parts, and the whole curtain wall is hung outside relative to the major structure. Therefore, the curtain wall is to be installed outdoors, causing inconvenience and unsafe installation. Although the curtain wall does not need to bear the main load, the weight of the curtain wall itself is born by the connecting parts and embedded parts. But the connecting parts and embedded parts provide lateral support for the curtain wall as cantilever supports, which might cause bending deformation and even fracture of the connecting parts and embedded parts. In case of invasion of wind, earthquake, air temperature and other natural forces, the curtain wall will lose its good stability or high safety.

For this purpose, a structure with the skeleton arranged inside the main wall has also appeared. For example, a curtain wall structure is disclosed in a patent with document number KR101215467. A curtain wall is also disclosed in a JP 2001311250A patent literature. Another wall is disclosed in a patent literature with document number CN200952216Y. Although these curtain walls or wall structures are different compared with the traditional curtain wall structures and solve some technical problems of the traditional curtain wall, the exposed skeletons demand for special materials, such as aluminum alloy, to ensure the strength and service life of the skeletons, which further results in high costs of the skeletons; if a high-strength and easily corroded material is selected, the cost will be reduced, but the skeleton would not get better protection, which might affect the service life of the wall. Meanwhile, for curtain walls in the above similar structures, the installation of the unit panels is not convenient, either.

SUMMARY OF THE PRESENT INVENTION

In order to better protect the keel frame and make it easy to form the wall, the invention provides a wall and a construction method thereof.

To achieve the above purpose, a new wall is provided. The wall comprises one or more of keel frames comprising more than two transverse keels and more than two longitudinal keels, wherein the keel frame is installed between uprights and floor slabs and connected with the inner side faces of the uprights and the floor slabs, cells are formed between adjacent transverse keels and adjacent longitudinal keels; each panel unit is installed in each cell; transverse mounting strips are arranged between the transverse keels and the panel units, and longitudinal mounting strips are arranged between the longitudinal keels and the panel units; characterized in that: the transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse inner mounting edge extending from the inner end of the transverse connecting edge toward the transverse keel, and a transverse inner stretching foot extending from the transverse inner mounting edge to inside; the longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal inner mounting edge extending from the inner end of the longitudinal connecting edge toward the longitudinal keel, and a longitudinal inner stretching foot extending from the longitudinal inner mounting edge to inside; an outdoor position corresponding to the transverse keel is provided with a transverse outer trim strip contacting with the transverse outer stretching foot; an indoor position corresponding to the transverse keel is provided with a transverse inner trim strip contacting with the transverse inner stretching foot; an outdoor position corresponding to the longitudinal keel is provided with a longitudinal outer trim strip contacting with the longitudinal outer stretching foot; an indoor position corresponding to the longitudinal keel is provided with a longitudinal inner trim strip contacting with the longitudinal inner stretching foot; outdoor positions corresponding to the uprights and beams are equipped with decorative items; the transverse inner mounting edge contacts with the inner side face of the transverse keel and is fixed to the transverse keel; the longitudinal inner mounting edge contacts with the inner side face of the longitudinal keel and is fixed to the longitudinal keel; the panel unit is installed from indoors to outdoors and stopped by the transverse stopping edge.

The invention also provides a new construction method of the wall. The construction method of a wall, characterized in including the following steps: (1) setting the keel frame comprising more than two transverse keels and more than two longitudinal keels into a space comprising the uprights and beams, fixing the upper and lower two transverse keels to the inner side faces of the beams, and fixing the outermost two longitudinal keels to the inner side faces of the uprights; the outer surface of the keel frame is flush with or protrudes from the outer surface of the beam; a cell is formed between adjacent transverse keels and adjacent longitudinal keels; (2) installing the transverse mounting strip fixed to and stretching across the transverse keel in the cell in which the panel units needs to be installed; Install installing the longitudinal mounting strip fixed to and stretching across the longitudinal keel in the cell in which the panel units needs to be installed; and the transverse mounting strip comprises a transverse connecting edge, a transverse stopping edge extending from the outer end of the transverse connecting edge toward the cell, a transverse outer stretching foot extending from the transverse stopping edge to the outside, a transverse inner mounting edge extending from the inner end of the transverse connecting edge toward the transverse keel, and a transverse inner stretching foot extending from the transverse inner mounting edge to inside; the transverse inner mounting edge is fixed to the transverse keel; the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal inner mounting edge extending from the inner end of the longitudinal connecting edge toward the longitudinal keel, and a longitudinal inner stretching foot extending from the longitudinal inner mounting edge to inside; the longitudinal inner mounting edge is fixed to the longitudinal keel; (3) installing the panel unit in the cell from indoor to outdoor, with the outer edges of the panel unit stopped by the transverse stopping edges and the longitudinal stopping edges; applying sealant respectively to the space between the panel unit and the transverse mounting strips and the space between the panel unit and the longitudinal mounting strips; (4) clamping the transverse inner trim strip contacting with the transverse inner stretching foot in an indoor position corresponding to the transverse keel; clamping the longitudinal inner trim strip contacting with the longitudinal inner stretching foot in an indoor position corresponding to the longitudinal keel; (5) fixing the decorative items in outdoor positions corresponding to the uprights and beams; (6) setting the transverse outer trim strip contacting with the transverse outer stretching foot in the outdoor position corresponding to the transverse keel; setting the longitudinal outer trim strip contacting with the longitudinal outer stretching foot in the outdoor position corresponding to the longitudinal keel.

For the wall in the above structure, since the transverse mounting strips, the longitudinal mounting strips, the transverse outer trim strips, the longitudinal outer trim strips, the transverse inner trim strips, the longitudinal inner trim strips are provided, the transverse mounting strips and the longitudinal mounting strips stretch cross the transverse keels and the longitudinal keel respectively and the inner and outer trim strips contact with the transverse and longitudinal mounting strips, so the transverse mounting strips, the longitudinal mounting strips, the transverse outer trim strips, the longitudinal outer trim strips, the transverse inner trim strips, the longitudinal inner trim strips clad the transverse keels and the longitudinal keels. For material selection of the keel frame, such materials as ferrous materials with good toughness, strength and lower cost are options. Therefore, it can not only ensure the strength of the keel frame but also protect the keel frame through the transverse mounting strips, the longitudinal mounting strips, the transverse outer trim strips, the longitudinal outer trim strips, the transverse inner trim strips, the longitudinal inner trim strips cladding the keel frame to protect the keel frame against corrosion. And it can also make the inner and outer wall surfaces beautiful. The construction method corresponding to the above wall comprises: install the transverse and longitudinal mounting strips to the keel frame, and then install the panel unit. Therefore, the installation parts of the wall have light weight and are convenient for construction; meanwhile, since the panel unit is installed from indoor to outdoor and stopped by the transverse and longitudinal stopping edges corresponding to the panel unit, the panel unit is easy to install, and the construction efficiency is high.

Furthermore, the outer edge of the transverse keel near the cell extends to form a transverse extending edge toward the cell, and the transverse stopping edge contacts with the transverse extending edge and is located at the inner side of the transverse extending edge; the outer edge of the longitudinal keel near the cell extends to form longitudinal extending edge toward the cell, and the longitudinal stopping edge contacts with the longitudinal extending edge and is located at the inner side of the longitudinal extending edge. For the structure, after the panel unit is installed in the cell, the transverse and longitudinal extending edges play the main stopping role on the panel unit, so that the installation of the panel unit is more secure and more reliable, resulting in high strength of the wall.

Furthermore, a transverse outer heat resisting sheet is arranged between the transverse mounting strip and the transverse outer trim strip, a transverse inner heat resisting sheet is arranged between the transverse mounting strip and the transverse inner trim strip; a longitudinal outer heat resisting sheet is arranged between the longitudinal mounting strip and the longitudinal outer trim strip, a longitudinal inner heat resisting sheet is arranged between the longitudinal mounting strip and the longitudinal inner trim strip. In the structure, the heat resisting sheets can have the heat insulation effect, the transverse and longitudinal outer trim strips contact with the outer heat resisting sheet and the transverse and longitudinal inner trim strips contact with an inner heat resisting sheet.

Therefore, the heat insulation effect of the wall is good under the action of the heat resisting sheets and the inner and outer trim strips.

Furthermore, the transverse mounting strip also comprises a transverse outer mounting edge fixed to the transverse keel; the longitudinal mounting strip also comprises a longitudinal outer mounting edge fixed to the longitudinal keel. The transverse and longitudinal outer mounting edges can improve the fixing firmness of the transverse and longitudinal mounting strips to further improve the stopping capability of the transverse and longitudinal stopping edges and further improve the strength and reliability of the wall.

Furthermore, a transverse outer snap is arranged on the transverse outer stretching foot, a transverse outer trim strip snap is arranged on the transverse outer trim strip; a transverse inner snap is arranged on the transverse inner stretching foot, a transverse inner trim strip snap is arranged on the transverse inner trim strip; a longitudinal outer snap is arranged on the longitudinal outer stretching foot, a longitudinal outer trim strip snap is arranged on the longitudinal outer trim strip; a longitudinal inner snap is arranged on the longitudinal inner stretching foot, a longitudinal inner trim strip snap is arranged on the longitudinal inner trim strip; and the transverse outer trim strip snap and the transverse outer snap are clamped to each other. The transverse inner and outer trim strips are installed in the form of buckles, easy and quick to install and remove; the longitudinal inner and outer trim strips are installed in the form of buckles, easy and quick to install and remove.

Furthermore, a transverse projection is arranged in the middle part of the inner side of the transverse outer trim strip, and transverse screws connected to the transverse projection are arranged on the transverse keel from indoor to outdoor; a transverse inner snap is arranged on the transverse inner stretching foot, a transverse inner trim strip snap is arranged on the transverse inner trim strip, and the transverse inner trim strip snap and the transverse inner snap are clamped to each other; a transverse projection is arranged in the middle part of the inner side of the longitudinal outer trim strip, and longitudinal screws connected to the longitudinal projection are arranged on the longitudinal keel from indoor to outdoor; a longitudinal inner snap is arranged on the longitudinal inner stretching foot, a longitudinal inner trim strip snap is arranged on the longitudinal inner trim strip, and the longitudinal inner trim strip snap and the longitudinal inner snap are clamped to each other. In this structure, the transverse and longitudinal outer trim strips are fixed respectively by the transverse screws and the longitudinal screws, so that the transverse and longitudinal outer trim strips are fixed much more firmly.

Furthermore, a transverse outer positioning strip is arranged at the inner side face of the transverse outer trim strip, and the transverse outer positioning strip is located at the inner side of the transverse outer stretching foot and contacts with the transverse outer stretching foot; a longitudinal outer positioning strip is arranged at the inner side face of the longitudinal outer trim strip, and the longitudinal outer positioning strip is located at the inner side of the longitudinal outer stretching foot and contacts with the longitudinal outer stretching foot. Before fixing the transverse and longitudinal outer trim strips by the transverse and longitudinal screws, in order to better position the transverse and longitudinal outer trim strips, it is realized by the transverse outer positioning strip and the longitudinal outer positioning strip, so that the transverse and longitudinal outer trim strips can be positioned in a more accurate manner to facilitate the installation of the transverse and longitudinal outer trim strips.

Furthermore, the inside surface of the transverse outer trim strip is flush with or far away from the outer surface of the keel frame; the outer surface of the transverse inner trim strip is flush with or far away from the inside surface of the keel frame; the inside surface of the longitudinal outer trim strip is flush with or far away from the outer surface of the keel frame; the outer surface of the longitudinal inner trim strip is flush with or far away from the inside surface of the keel frame. In this way, it is unnecessary for the inner and outer trim strips have openings at the intersection of the transverse keel and the longitudinal keel to enable the installation of the inner and outer trim strips, which will result in lower processing requirements and costs for the inner and outer trim strips.

Furthermore, the transverse outer mounting edge, which is fixed to the transverse keel connected with the beams, stretches to the outside with the transverse connecting foot, the transverse outer snap is arranged on the transverse connecting foot, the transverse outer trim strip in a position corresponding to the transverse keel fixed to the beam is clamped on the transverse connecting foot and transverse outer stretching foot, and the transverse outer snap is clamped to the transverse outer trim strip snap. In this way, it is easy to clamp the transverse outer trim strip and the longitudinal outer trim strip in positions corresponding to the beams and uprights.

Furthermore, the said panel unit is a single-layered panel stopped by the transverse stopping edge and the longitudinal stopping edge.

Furthermore, a transverse space inside trim strip is installed between two adjacent longitudinal keels and on the side wall of the transverse mounting strip, the outer end of the transverse space inside trim strip contacts with the single-layered panel, and the middle part of the transverse space inside trim strip contacts with the transverse inner trim strip; a longitudinal space inside trim strip is installed between two adjacent transverse keels and on the side wall of the longitudinal mounting strip, the outer end of the longitudinal space inside trim strip contacts with the single-layered panel, and the middle part of the transverse space inside trim strip contacts with the longitudinal inner trim strip. When the single-layered panel is used, the inner side of the keel frame will protrude from the single-layered panel so much. If the lateral margins of the transverse and longitudinal inner trim strips stretch into and stop the single-layered panel, an opening must be provided at the intersection of the transverse and longitudinal keels, thus the processing difficulty and cost for the transverse and longitudinal inner trim strips will be increased. When the transverse and longitudinal\space inside trim strips are provided, these problems may be avoided, and the keel frame can also be better protected.

Furthermore, the said transverse space inside trim strip comprises a transverse trim part, a transverse bent part and a transverse fixed part, wherein the transverse bent part is connected between the transverse trim part and the transverse fixed part; the transverse bent part extends from one end of the transverse trim part to the transverse keel in a bending manner; the inner end of the transverse trim part contacts with the transverse inner trim strip; the transverse fixed part is fixed to the transverse mounting strip; the said longitudinal space inside trim strip comprises a longitudinal trim part, a longitudinal bent part and a longitudinal fixed part, wherein the longitudinal bent part is connected between the longitudinal trim part and the longitudinal fixed part; the longitudinal bent part extends from one end of the longitudinal trim part to the longitudinal keel in a bending manner; the inner end of the longitudinal trim part contacts with the longitudinal inner trim strip; the longitudinal fixed part is fixed to the longitudinal mounting strip. The transverse space inner trim strip can not only be fixed through the transverse fixed part, but also make the transverse trim part be flush with the side edge of the transverse inner trim strip after the transverse inner trim strip is installed by provision of the transverse bent part, making the inner side face of the wall more beautiful. Similarly, the longitudinal space inner trim strip can not only be fixed through the longitudinal fixed part but also make the longitudinal trim part be flush with the side edge of the longitudinal inner trim strip after the longitudinal inner trim strip is installed by provision of the longitudinal bent part, making the inner side face of the wall more beautiful.

Furthermore, the transverse trim part is connected with a transverse rod contacting with the transverse mounting strip; the longitudinal trim part is connected with a longitudinal rod contacting with the longitudinal mounting strip. On the one hand, the transverse and longitudinal rods can increase the strength of the transverse and longitudinal space inside trim strips; on the other hand, they can ensure that the transverse trim part is flush with the side edge of the transverse inner trim strip and the longitudinal trim part is flush with the side edge of the longitudinal inner trim strip.

Furthermore, the inner end of the transverse trim part extends to the inside with a transverse positioning part that is positioned to the transverse inner trim strip; the inner end of the longitudinal trim part extends to the inside with a longitudinal positioning part that is positioned to the longitudinal inner trim strip. In this way, the transverse and longitudinal inner trim strips can be installed in a more accurate and faster manner.

Furthermore, to improve the sealing performance, sealant is provided between the single-layered panel and the transverse outer trim strip, between the single-layered panel and the longitudinal outer trim strip, between the single-layered panel and the transverse mounting strip, between the single-layered panel and the longitudinal mounting strip.

Furthermore, the transverse inner mounting edge extends to the inside with a transverse positioning part positioned to the transverse inner trim strip; a longitudinal inner decorative edge extends to the inside with a longitudinal positioning part positioned to the longitudinal inner trim strip. In this way, the transverse and longitudinal inner trim strips can be installed in a more accurate and faster manner.

Furthermore, the panel unit comprises more than two panels, the outermost panel is stopped by the transverse stopping edge and the longitudinal stopping edge, the innermost panel is stopped by the transverse inner trim strip and the transverse outer trim strip, and there is a gap between adjacent panels.

Furthermore, a spacing strip fixed to the keel frame is arranged between adjacent panels to determine the distance between panels much more accurately and position the panels. Furthermore, an anti-theft grating fixed to the keel frame is arranged between adjacent panels to play the role of theft protection. Furthermore, a corrugated plate fixed to the keel frame is arranged between adjacent panels to play the role of guard against theft and shock absorption. Furthermore, a heat insulation board, fire prevention board or sound insulation board fixed to the keel frame is arranged between adjacent panels to play the role of heat insulation, fire prevention or sound insulation.

Furthermore, the exterior part of the keel frames protrudes from the outer surface of beams.

Furthermore, the said decorative item comprises fixed parts and an intermediate decorative part connected between the fixed parts, the said intermediate decorative part is tabular, semicircular or square or in the shape of a roman column, so that it can better play a role in simulation decoration.

DETAILED DESCRIPTION OF THE INVENTION

Embodiment 1

Figure 1:
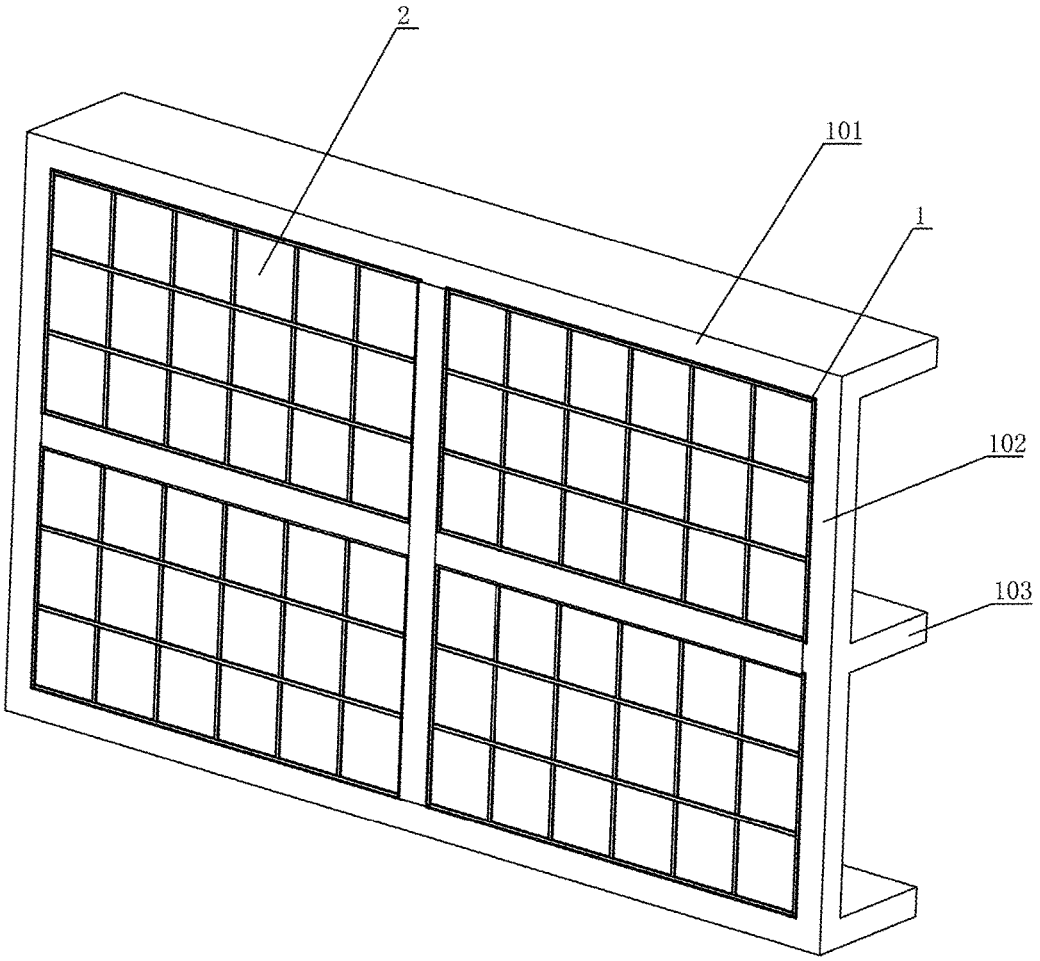
FIG. 1 is the solid view of the wall.
Figure 2:
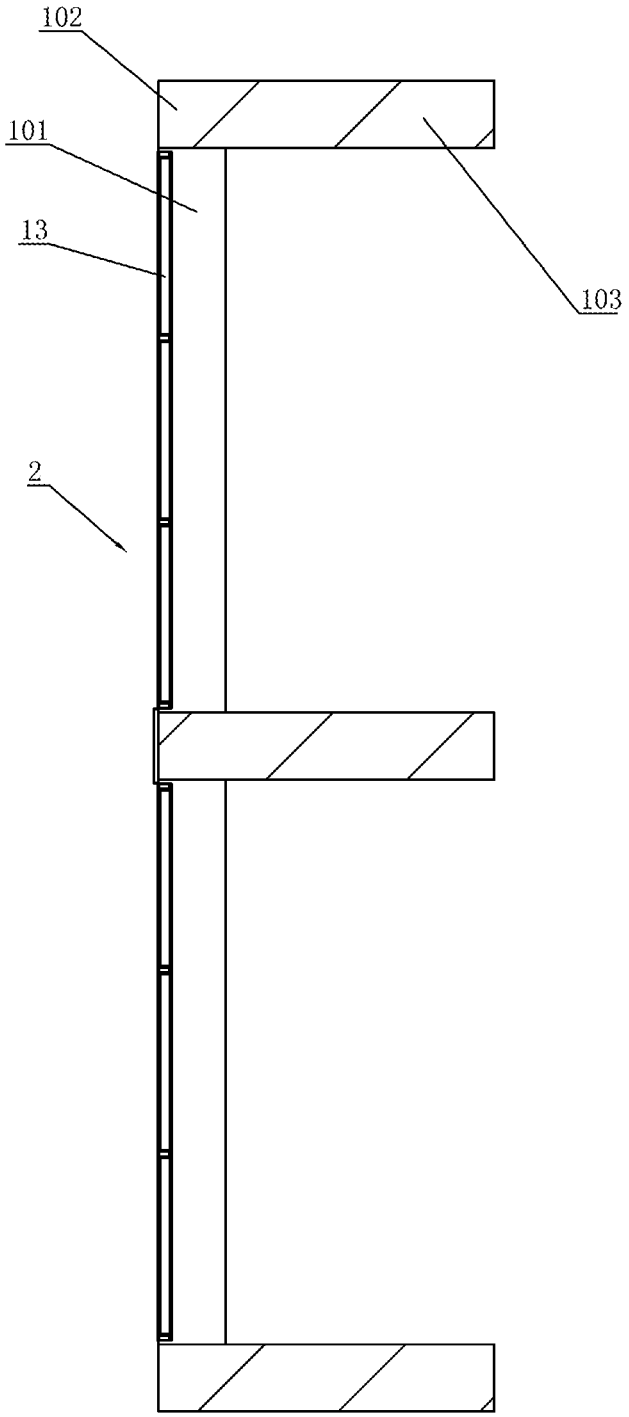
FIG. 2 is the sectional view of the wall of Embodiment 1.
Figure 3:
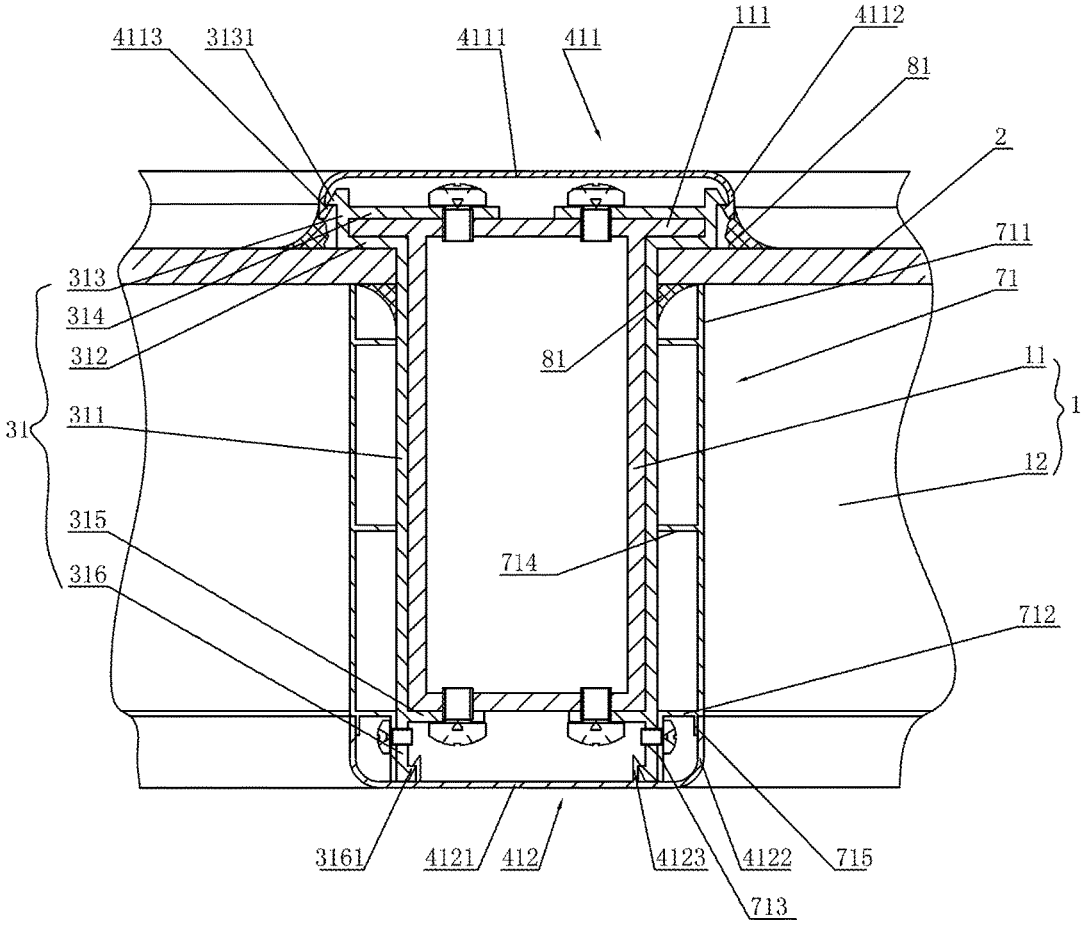
FIG. 3 is the structure diagram of the longitudinal keels, the longitudinal mounting strip, the longitudinal inner and outer trim strips of Embodiment 1.
Figure 4:
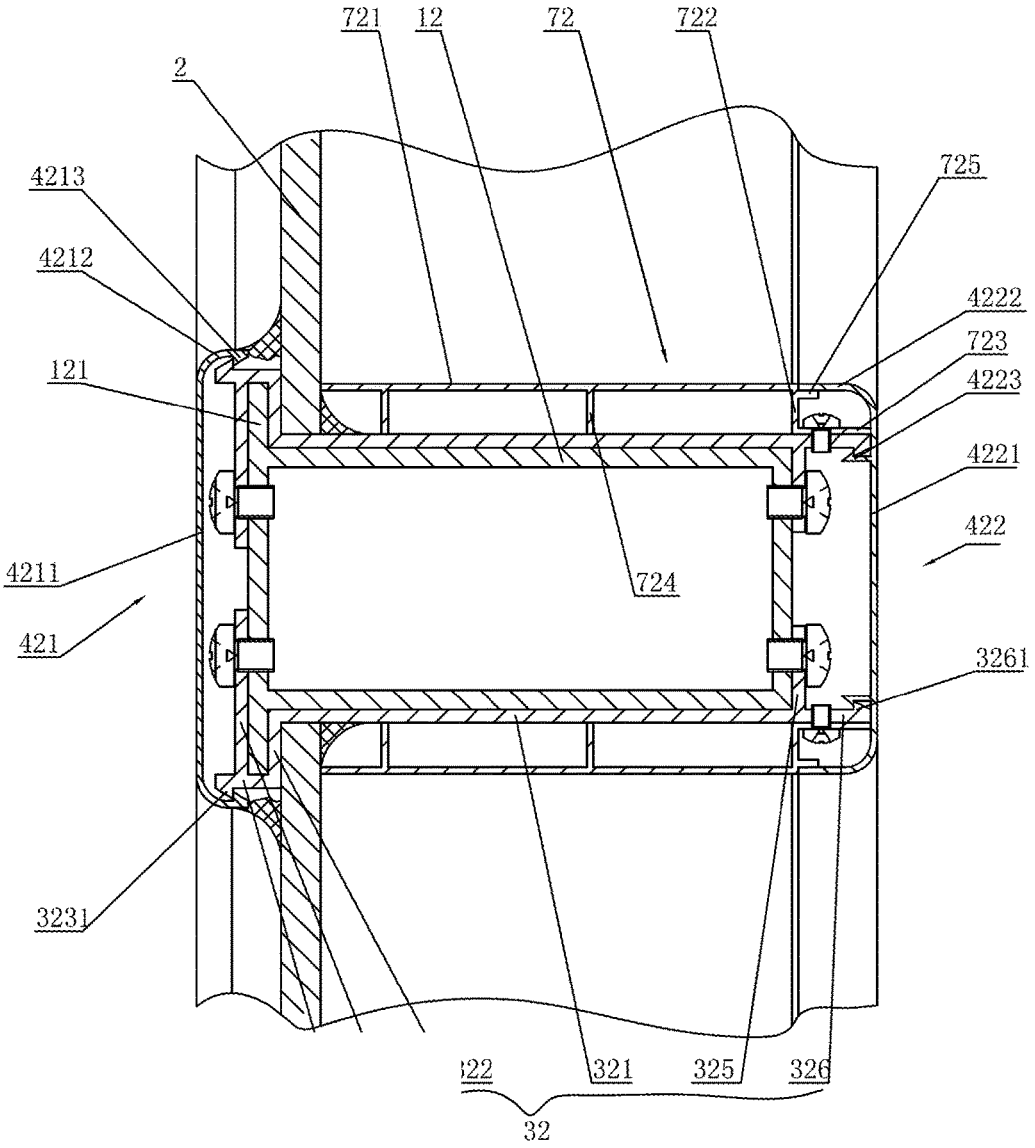
FIG. 4 is the structure diagram of the transverse keels, the transverse mounting strip, the transverse inner and outer trim strips of Embodiment 1.

As shown in FIG. 1 and FIG. 2, the wall comprises a main body comprising beams 101, uprights 102 and floor slabs 103, wherein the uprights 102 are formed between beams 101, and the floor slabs 103 and the beams 101 are mutually connected. As shown in FIG. 3 and FIG. 4, the wall also comprises a keel frame 1 comprising more than two longitudinal keels 11 and more than two transverse keels 12, the keel frame 1 is installed in a space formed by the uprights 102 and the floor slabs 103, the longitudinal keels 11 on the left and right sides of the keel frame 1 located within the space are fixed to the inner side faces of the uprights 102, the uppermost and undermost transverse keels 12 are fixed to the inner side faces of the beams 101, and the said keel frame 1 can be either flush with or protrude from the outer surface of the beams 101. Cells 13 are formed between adjacent transverse keels 12 and adjacent longitudinal keels 11; the panel units 2 are installed in the Cell 13; a longitudinal mounting strips 31 are arranged between the longitudinal keel 11 and the panel units 2, transverse mounting strips 32 are arranged between the transverse keels 12 and the panel units 2.

As shown in FIG. 3, the outer edge of the longitudinal keel 11 near the Cell 13 extends to form longitudinal extending edge 111 toward the Cell 13, the longitudinal keel 11 is in a hollow structure and made of a preferred iron material of higher toughness and strength. The transverse keel 12 is in a hollow structure. The outer edge of the transverse keel 12 near the Cell 13 extends to form a transverse extending edge 121 toward the Cell 13, the transverse keel 12 is in a hollow structure and made of a preferred iron material of higher toughness and strength.

As shown in FIG. 3, the longitudinal mounting strip 31 stretches across the longitudinal keel 11 from indoor to outdoor, and the longitudinal mounting strip 31 comprises a longitudinal connecting edge 311, a longitudinal stopping edge 312 extending from the outer end of the longitudinal connecting edge 311 toward the Cell 13, a longitudinal outer stretching foot 313 extending from the longitudinal stopping edge 312 to the outside, a longitudinal outer mounting edge 314 extending from longitudinal outer stretching foot 313 toward the longitudinal keel 11, a longitudinal inner mounting edge 315 extending from the inner end of the longitudinal connecting edge 311 toward the longitudinal keel 11, and a longitudinal inner stretching foot 316 extending from the longitudinal inner mounting edge 315 to inside. A longitudinal clamping slot is formed between the longitudinal outer stopping edge and the longitudinal outer mounting edge 314. After the longitudinal mounting strip 31 is installed on the longitudinal keel 11, the longitudinal inner mounting edge 315 is stopped by the inner side face of the longitudinal keel 11 and fixed to the longitudinal keel 11 by screws. At the same time, the longitudinal extending edge 111 is clamped into the longitudinal clamping slot, the longitudinal outer mounting edge 314 is fixed to the outer side face of the longitudinal keel 11 by screws, and the longitudinal stopping edge 312 is stopped by the longitudinal extending edge 111. A longitudinal outer snap 3131 is arranged on the longitudinal outer stretching foot 313, and a longitudinal inner snap 3161 is arranged on the longitudinal inner stretching foot 316.

Figure 5:
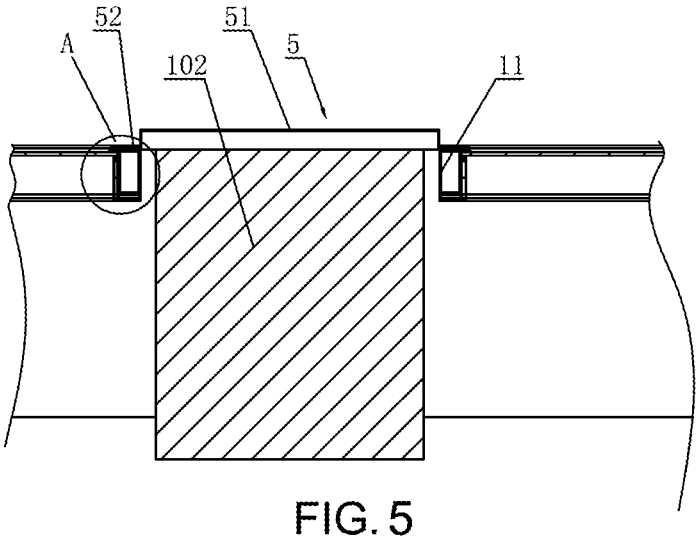
FIG. 5 is the structure diagram of the longitudinal keels installed together with the uprights of Embodiment 1.
Figure 7:
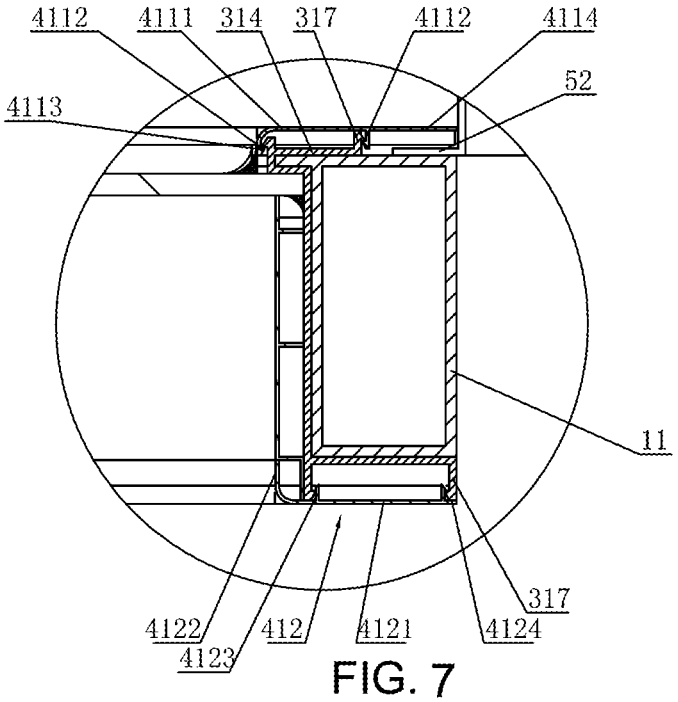
FIG. 7 is the enlarged view of the Part A of FIG. 5.

As shown in FIG. 5 and FIG. 7, the longitudinal outer mounting edge 314 fixed to the longitudinal keel 11 connected with the uprights 102 extends to the outside with a longitudinal connecting foot 317, and a longitudinal outer snap is arranged on the longitudinal connecting foot 317; the longitudinal inner mounting edge 315 fixed to the longitudinal keel 11 connected with the uprights 102 extends to the outside with a longitudinal connecting foot 317, and a longitudinal outer snap is arranged on the longitudinal connecting foot 317.

The longitudinal mounting strip 31 is a plastic part

As shown in FIG. 4, the transverse mounting strip 32 stretches across the transverse keel from indoor to outdoor, and the transverse mounting strip 32 comprises a transverse connecting edge 321, a transverse stopping edge 322 extending from the outer end of the transverse connecting edge 321 toward the Cell 13, a transverse outer stretching foot 323 extending from the transverse stopping edge 322 to the outside, a transverse outer mounting edge 324 extending from a transverse outer stretching foot 323 toward the transverse keel 12, a transverse inner mounting edge 325 extending from the inner end of the transverse connecting edge 321 toward the transverse keel 12, and a transverse inner stretching foot 326 extending from the transverse inner mounting edge 325 to inside. A transverse clamping slot is formed between the transverse outer stopping edge and the transverse outer mounting edge 324. After the transverse mounting strip 32 is installed on the transverse keel 12, the transverse inner mounting edge 325 is stopped by the inner side face of the transverse keel 12 and fixed to the transverse keel 12 by screws. At the same time, the transverse extending edge 121 is clamped into the transverse clamping slot, the transverse outer mounting edge 324 is fixed to the outer side face of the transverse keel 12 by screws, and the transverse stopping edge 322 is stopped by the transverse extending edge 121. A transverse outer snap 3231 is arranged on the transverse outer stretching foot 323, and a transverse inner snap 3261 is arranged on the transverse inner stretching foot 326.

Figure 6:
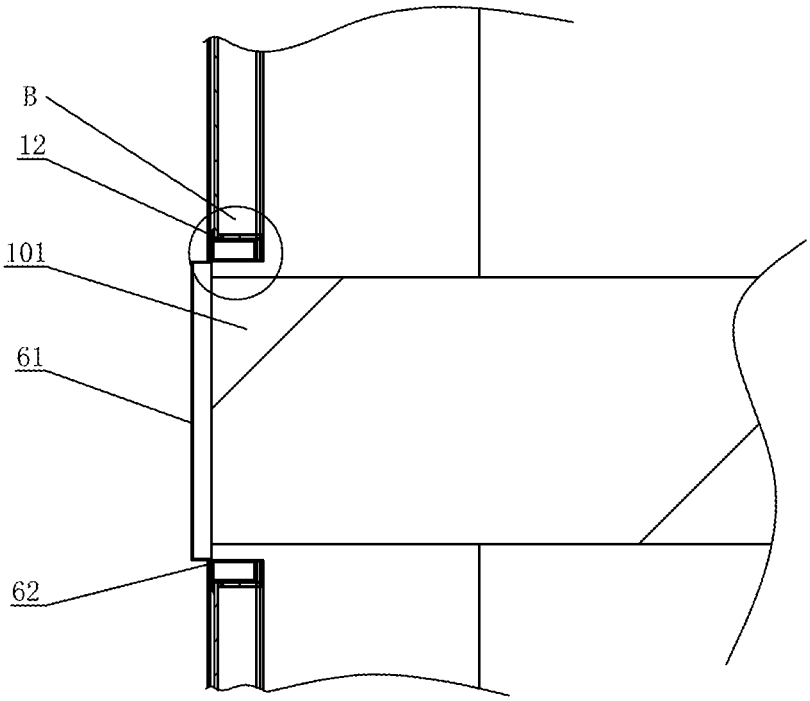
FIG. 6 is the structure diagram of the transverse keels installed together with the beams of Embodiment 1.
Figure 8:
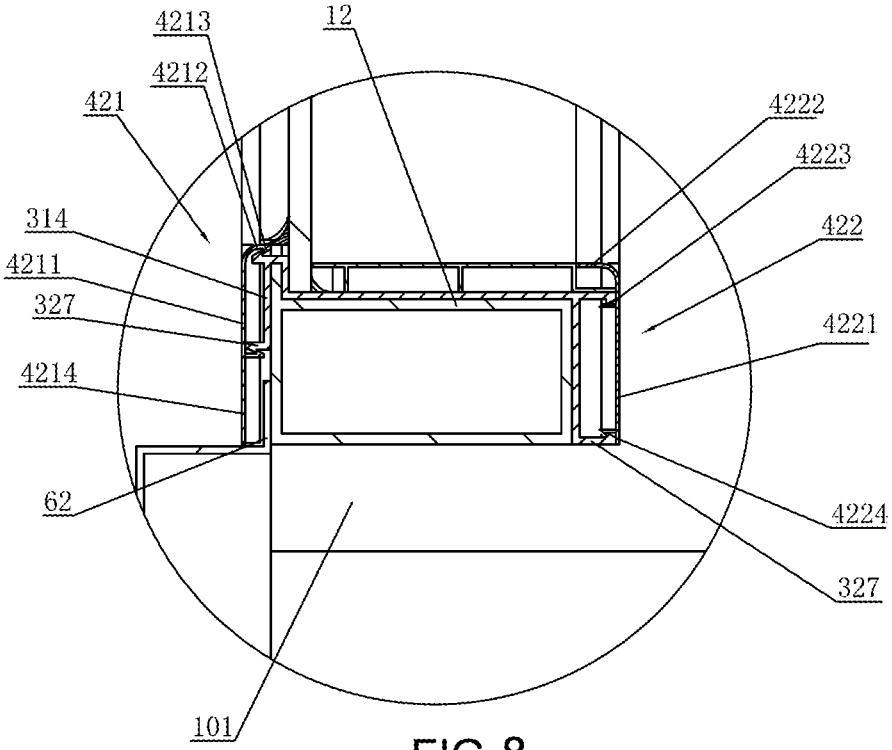
FIG. 8 is the enlarged view of the Part B of FIG. 6.

As shown in FIG. 6 and FIG. 8, the transverse outer mounting edge 324, which is fixed to the transverse keel 12 connected with the beams 101, stretches to the outside with the transverse connecting foot 327, and the transverse outer snap is arranged on the transverse connecting foot 327; the transverse inner mounting edge 325, which is fixed to the transverse keel 12 connected with the beams 101, stretches to the outside with the transverse connecting foot 327, and the transverse outer snap is arranged on the transverse connecting foot 327.

The transverse mounting strip 32 is a plastic part.

As shown in FIG. 3, the longitudinal outer trim strip 411 and the longitudinal inner trim strip 412 are respectively arranged outdoors and indoors in positions corresponding to the longitudinal keels 11. Prevent the case that an opening is to be provided in a position corresponding to the transverse keel 12 after the longitudinal outer trim strip is installed the inner surface of the longitudinal outer trim strip is flush with or far away from the outer surface of the keel frame 1; prevent the case that an opening is to be provided in a position corresponding to the transverse keel 12 after the longitudinal inner trim strip 412 is installed the outer surface of the longitudinal inner trim strip 412 is flush with or far away from the inner surface of the keel frame 1; The longitudinal outer trim strip 411 can be fixed by screws passing through the longitudinal keel 11. In order to fix the longitudinal outer trim strip 411 conveniently and reliably, a longitudinal projection is arranged in the middle part of the inner side of the longitudinal outer trim strip 411, namely the longitudinal outer trim strip 411 comprises a longitudinal outer decorative edge, longitudinal projections are arranged in the longitudinal outer decorative extending edges connected to both ends of the longitudinal outer decorative edge and extending in the same direction and longitudinal projections in the middle part of the inner side of the longitudinal outer trim strip 411, and the longitudinal outer positioning strip is arranged at the inner side face of the longitudinal outer trim strip 411. After the longitudinal outer trim strip 411 is installed, the longitudinal outer trim strip 411 contacts with the longitudinal mounting strip 31, the longitudinal outer positioning strip is located at the inner side of the longitudinal outer stretching foot, and meanwhile, no longitudinal outer snap 3131 is to be provided on the longitudinal outer stretching foot.

As shown in FIG. 3, the longitudinal outer trim strips 411 not on the longitudinal keel 11 fixed to the upright 102 comprises the longitudinal outer decorative edge 4111, the longitudinal outer decorative extending edges 4112 connected to both ends of the longitudinal outer decorative edge 4111 and extending in the same direction and a longitudinal outer trim strip snap 4113 arranged at the inner side of the longitudinal outer decorative extending edge 4112. The longitudinal outer trim strip snap 4113 is clamped to the longitudinal outer snap 3131 on the longitudinal mounting strips 31 on both sides of the corresponding longitudinal keel 11, so that the longitudinal outer trim strip is fixed to the longitudinal mounting strip. As shown in FIG. 7, the longitudinal outer trim strip 411 on the longitudinal keel 11 fixed to the upright 102 comprises a longitudinal outer decorative edge 4111, the longitudinal outer decorative extending edges 4112 connected to both ends of the longitudinal outer decorative edge 4111 and extending in the same direction, the longitudinal outer trim strip snap 4113 arranged at the inner side of the longitudinal outer decorative extending edge 4112, and a longitudinal decorative item outer stopping edge 4114 extending from one end of the longitudinal outer decorative edge 4111 to the upright direction. Corresponding to the longitudinal keel 11 installed to the upright 102, the longitudinal outer trim strip snap 4113 on its corresponding longitudinal outer trim strip 411 is clamped to the longitudinal outer snap 3131 on the same longitudinal mounting strip 31 and the longitudinal outer snap on the longitudinal connecting foot 317.

As shown in FIG. 3, the longitudinal inner trim strip 412 not on the longitudinal keel 11 fixed to the upright 102 comprises the longitudinal inner decorative edge 4121, the longitudinal inner decorative extending edges 4122 connected to both ends of the longitudinal inner decorative edge 4121 and extending in the same direction and a longitudinal inner trim strip snap 4123 arranged on the longitudinal outer inner decorative extending edge. The longitudinal inner trim strip snap 4123 is clamped to the longitudinal inner snap 3161 on the longitudinal mounting strips 31 on both sides of the corresponding longitudinal keel 11, so that the longitudinal inner trim strip is fixed to the longitudinal mounting strip. As shown in FIG. 7, the longitudinal inner trim strip 412 on the longitudinal keel 11 fixed to the upright 102 comprises a longitudinal inner decorative edge 4121, a longitudinal inner decorative extending edge 4122 connected to one end of the longitudinal inner decorative edge 4121, the longitudinal inner trim strip snap 4123 arranged on the longitudinal inner decorative edge 4121, and a longitudinal decorative item inner stopping edge 4124 extending from one end of the longitudinal inner decorative edge 4121 to the upright direction. Corresponding to the longitudinal keel 11 installed to the upright 102, the longitudinal inner trim strip snap 4123 on its corresponding longitudinal inner trim strip is clamped to the longitudinal inner snap 3161 on the same longitudinal mounting strip 31 and the longitudinal inner snap on the longitudinal connecting foot 317.

As shown in FIG. 4, the transverse outer trim strips 421 and the transverse inner trim strips 422 are respectively arranged outdoors and indoors in positions corresponding to transverse keel 12. The inside surface of the transverse outer trim strip 421 is flush with or far away from the outer surface of the keel frame 1 to prevent the provision of an opening in the position of the longitudinal keel 11 after the transverse outer trim strip 421 is installed; the outer surface of the transverse inner trim strip 422 is flush with or far away from the inside surface of the keel frame 1 to prevent the provision of an opening in the position of the longitudinal keel 11 after the transverse inner trim strip is installed. The transverse outer trim strip may be fixed by screws passing through the transverse keel 12. In order to fix the transverse outer trim strip conveniently and reliably, the transverse projection is arranged in the middle part of the inner side of the transverse outer trim strip, namely that the transverse outer trim strip comprises a transverse outer decorative edge, transverse outer decorative extending edges 4212 connected to both ends of the transverse outer decorative edge and extending in the same direction, and a transverse projection arranged in the middle part of the inner side of the transverse outer trim strip, wherein a transverse outer positioning strip is arranged at the inner side face of the transverse outer trim strip. After the transverse outer trim strip is installed, the transverse outer trim strip contacts with the transverse mounting strip 32, and the transverse outer positioning strip is located at the inner side of the transverse outer stretching foot. Meanwhile, no transverse outer snap is to be provided on the transverse outer stretching foot.

As shown in FIG. 4, the transverse outer trim strip 421 not on the transverse keel 12 fixed to the beam 101 comprises the transverse outer decorative edge 4211, the transverse outer decorative extending edges 4212 connected to both ends of the transverse outer decorative edge 4211 and extending in the same direction and a transverse outer trim strip snap 4213 arranged at the inner side of the transverse outer decorative extending edge. The transverse outer trim strip snap 4213 is clamped to the transverse outer snap 3231 on the transverse mounting strips 32 on both sides of the corresponding transverse keel 12, so that the transverse outer trim strip is fixed to the transverse mounting strip 32. As shown in FIG. 8, the transverse outer trim strip 421 on the transverse keel 12 fixed to the beam 101 comprises the transverse outer decorative edge 4211, the transverse outer decorative extending edges 4212 connected to both ends of the transverse outer decorative edge 4211 and extending in the same direction, the transverse outer trim strip snap 4213 arranged at the inner side of the transverse outer decorative extending edge, and the transverse decorative item outer stopping edge 4214 extending from one end of the transverse outer decorative edge 4211 to the direction of the beam 101. Corresponding to the transverse keel 12 installed to the beam 101, the transverse outer trim strip snap 4213 on its corresponding transverse outer trim strip is clamped to the transverse outer snap 3231 on the same transverse mounting strip 32 and the transverse outer snap on the transverse connecting foot 327.

As shown in FIG. 4, the transverse inner trim strip 422 not on the transverse keel 12 fixed to the beam 101 comprises a transverse inner decorative edge 4221, the transverse inner decorative extending edges 4222 connected to both ends of the transverse inner decorative edge 4221 and extending in the same direction, and a transverse inner trim strip snap 4223 arranged on the transverse inner decorative edge. The transverse inner trim strip snap 4223 is clamped to the transverse inner snap 3261 on the transverse mounting strips 32 on both sides of the corresponding transverse keel 12, so that the transverse inner trim strip is fixed to the transverse mounting strip 32.

As shown in FIG. 8, the transverse inner trim strip on the transverse keel fixed to the beam 101 comprises the transverse inner decorative edge, a transverse inner decorative extending edge connected to one end of the transverse inner decorative edge 4221, a transverse inner trim strip snap 4223 arranged on the transverse inner decorative edge 4221, and a transverse decorative item inner stopping edge 4224 extending from one end of the transverse inner decorative edge 4221 to the direction of the beam 101. Corresponding to the transverse keel 12 installed to the beam 101, the transverse inner trim strip snap 4223 on its corresponding transverse inner trim strip is clamped to the transverse inner snap 3261 on the same transverse mounting strip 32 and the transverse inner snap 3261 on the transverse connecting foot 327.

The transverse inner trim strip, the transverse outer trim strip The transverse inner and outer trim strips the longitudinal inner trim strip and the longitudinal outer trim strip 411 the longitudinal inner and outer trim strips) are made of aluminum alloy or plastic.

As shown in FIG. 5, decorative items 5 are provided both outdoors and indoors in positions corresponding to the uprights 102, wherein each decorative item comprises fixed parts 52 and intermediate decorative parts 51 linking the fixed parts 52; the fixed parts 52 are fixed to the longitudinal keels 11 located at both sides of the upright 102; the fixed part located outdoors is stopped or covered by the outer stopping edge of the longitudinal decorative item; the fixed part located indoors is stopped or covered by the longitudinal decorative item inner stopping edge 4124; the intermediate decorative part is tabular, semicircular or square, or in the shape of a roman column.

As shown in FIG. 6, decorative items 5 are provided both outdoors and indoors in positions corresponding to the beams 101, wherein each decorative item comprises fixed parts 62 and intermediate decorative parts 61 linking the fixed parts 62; the fixed parts 62 are fixed to the transverse keels 12 located at both sides of the beam 101; the fixed part located outdoors is stopped or covered by the transverse decorative item outer stopping edge 4214; the fixed part located indoors is stopped or covered by the transverse decorative item inner stopping edge 4224; the intermediate decorative part is tabular, semicircular or square, or in the shape of a roman column.

The panel units 2 is a single-layered panel that is a glass plate, a metal plate, an inorganic material plate or an organic material plate etc.

After the single-layered panel is installed inside each Cell 13, the edges of the single-layered panel are stopped by the longitudinal stopping edges 312 and the transverse stopping edges 322. In addition, since the thickness of the single-layered panel is far less than the thickness of the keel frame 1, there is still a large distance between the inner surface of the single-layered panel and the longitudinal and transverse inner decorative extending edges. On the one hand, the longitudinal and transverse mounting strips 32 are exposed; on the other hand, the inner surface of the single-layered panel cannot be stopped so that the fixing firmness of the single-layered panel is limited. For this purpose, the longitudinal space inside trim strip 71 is installed between two adjacent transverse keels 12 and on the side wall of the longitudinal mounting strip 31, and the transverse space inside trim strip 72 is installed between two adjacent longitudinal keels 11 and on the side wall of the transverse mounting strip 32.

As shown in FIG. 3, the longitudinal space inside trim strip 71 comprises a longitudinal trim part 711, a longitudinal bent part 712 and a longitudinal fixed part 713, wherein the longitudinal bent part 712 is connected between the longitudinal trim part 711 and the longitudinal fixed part 713; the longitudinal bent part 712 extends from one end of the longitudinal trim part 711 to the longitudinal keel 11 in a bending manner; longitudinal rods 714 are arranged on the longitudinal trim part 711; the inner end of the longitudinal trim part 711 extends to the indoor direction with the longitudinal positioning part 715. During installation, fix the longitudinal fixed part 713 to the side face of the longitudinal keel 11 by screws, stop the outer end of the longitudinal trim part 711 against the single-layered panel, make the longitudinal rods 714 contact with the longitudinal keel 11, and then buckle up the longitudinal inner trim strip. When the longitudinal inner trim strip is buckled up, the longitudinal positioning part 715 has the positioning action on the longitudinal inner decorative extending edge for buckling up the longitudinal inner trim strip. In addition, after the longitudinal inner trim strip is installed, the outer side face of the longitudinal inner decorative extending edge is flush with the outer side edge of the longitudinal trim part, making the interior wall more beautiful, and the inner end of the longitudinal trim part contacts with the longitudinal inner trim strip.

As shown in FIG. 4, the transverse space inside trim strip 72 comprises a transverse trim part 721, a transverse bent part 722 and a transverse fixed part 723, wherein the transverse bent part 722 is connected between the transverse trim part 721 and the transverse fixed part 723; the transverse bent part 722 extends from one end of the transverse trim part 721 to the transverse keel 12 in a bending manner; transverse rods 724 are arranged on the transverse trim part 721; the inner end of the transverse trim part 721 extends to the indoor direction with the transverse positioning part 725.

During installation, fix the transverse fixed part 723 to the side face of the transverse keel 12 by screws, stop the outer end of the transverse trim part 721 against the single-layered panel, make the transverse rods 724 contact with the transverse keel, and then buckle up the transverse inner trim strip. When the transverse inner trim strip is buckled up, the transverse positioning part 725 has the positioning action on the transverse inner decorative extending edge for buckling up the transverse inner trim strip. In addition, after the transverse inner trim strip is installed, the outer side face of the transverse inner decorative extending edge is flush with the outer side edge of the transverse trim part 721, making the interior wall more beautiful, and the inner end of the transverse trim part 721 contacts with the transverse inner trim strip.

As shown in FIG. 3 and FIG. 4, in order to improve the sealing and thermal insulation performances, sealant is provided between the outer surface of the single-layered panel and the longitudinal outer trim strip 411, between the outer surface of the single-layered panel and the transverse outer trim strip 421, between the inner surface of the single-layered panel and the transverse mounting strip 32 and between the inner surface of the single-layered panel and the transverse mounting strip 32.

In this embodiment, if in the wall windows need to be installed in the wall, the existing sliding window or casement window may be directly installed in the Cell.

The construction method for the above wall is as follows.

(1) Set the keel frames 1 comprising more than two transverse keels 12 and more than two longitudinal keels 11 into a space comprising the uprights 102 and beams 101, fix the upper and lower two transverse keels 12 to the inner side faces of the beams 101, and fix the outermost two longitudinal keels 11 to the inner side faces of the uprights 102; the outer surface of the keel frame 1 is flush with or protrudes from the outer surface of the beam 101; a Cell 13 is formed between adjacent transverse keels 12 and adjacent longitudinal keels 11;

(2) Install the longitudinal mounting strip 31 fixed to and stretching across the longitudinal keel 11 in the Cell 13 in which the panel units 2 needs to be installed; Install the transverse mounting strip 32 fixed to and stretching across the transverse keel 12 in the Cell 13 in which the panel units 2 needs to be installed;

(3) Install the single-layered panel in the Cell 13 from indoor to outdoor in the Cell 13 where the single-layered panel needs to be installed, and stop the edge of the single-layered panel from the longitudinal stopping edge 312 and the transverse stopping edge 322; apply sealant respectively between the single-layered panel and the transverse mounting strip 32 and between the single-layered panel and the longitudinal mounting strip 31;

(4) Fix the longitudinal space inside trim strip 71 on the longitudinal keel 11 at both sides of the Cell 13 installed with the single-layered panel and between two adjacent transverse keels 12, and make the outer end face of the longitudinal space inside trim strip 71 contact with the single-layered panel; fix the transverse space inside trim strip 72 on the transverse keel 12 at the upper and lower sides of the Cell 13 installed with the single-layered panel and between two adjacent longitudinal keels 11, and make the outer end face of the transverse space inside trim strip 72 contact with the single-layered panel;

(5) Set the longitudinal inner trim strip 412 clamped to the longitudinal mounting strip 31 in an indoor position corresponding to the longitudinal keel 11; Set the transverse inner trim strip 422 clamped to the transverse mounting strip 32 in an indoor position corresponding to the transverse keel 12;

(6) Fix the decorative items 5 in outdoor positions corresponding to the uprights 102 and beams 101;

(7) Provide the longitudinal outer trim strip 411 clamped to the longitudinal outer snap in an outdoor position corresponding to the longitudinal keel 11; provide the transverse outer trim strip 421 clamped to the transverse outer snap in an outdoor position corresponding to the transverse keel 12;

(8) Apply sealant between the single-layered panel and the longitudinal outer trim strip 411 and between the single-layered panel and the transverse trim strip;

(9) If windows need to be installed in the wall, the existing sliding window or casement window may be installed in the Cell without the panel units. The sliding window comprises a frame body and glass arranged in the frame body, wherein the frame body is arranged between two adjacent transverse keels 12 through guide rails. The casement window comprises an outer frame body and an inner frame body, wherein the outer frame body is fixed in the Cell, and the middle parts at both sides of the inner frame body are interconnected to longitudinal keel 11 at two adjacent sides by a connecting rod.

In this embodiment, due to the provision of the longitudinal extending edge 111 and the transverse extending edge 121, the longitudinal extending edge 111 and the transverse extending edge 121 play a main role of force bearing, and the longitudinal stopping edge 312 and the transverse stopping edge 322 mainly play a role of isolation. In this way, the strength for resisting the panel units 2 is high, and the panel units 2 is fixed firmly and reliably. Since the keel frame 1 is wrapped by the longitudinal and transverse mounting strips, longitudinal and transverse outer trim strips and longitudinal and transverse inner trim strips, there is no exposed part of the keel frame 1. In this way, the waterproof and dustproof performance for the keel frame 1 is good, and the protection performance for the keel frame 1 is good. Therefore, a low cost, good toughness and good strength iron material may be selected for the keel frame 1 during wall building. In this way, not only the wall strength can be guaranteed, but also the wall cost can be reduced. In addition, in the description, the longitudinal and transverse mounting strips use plastic parts having good heat insulation effect, the longitudinal and transverse outer trim strips are directly clamped to the longitudinal and transverse mounting strips, and the longitudinal and transverse inner trim strips are directly clamped to the longitudinal and transverse mounting strips. In this structure, the longitudinal and transverse mounting strips not only play the role of the fixed panel units 2 and the fixed inner and outer trim strips, but also play the role of an insulated bridge so that the wall has good heat insulation effect. In this embodiment, either aluminum profile or plastic part is recommended for the inner and outer trim strips. Again, by the provision of the longitudinal and transverse space inside trim strips, on the one hand, the longitudinal and transverse inner trim strips are placed at the junction of keel frame 1 to form an opening, and on the other hand, the purpose of protection of the longitudinal and transverse mounting strips can be achieved, thus increasing the service life of the longitudinal and transverse mounting strips. The wall has the advantage of simple structure and construction method, and therefore, the wall can improve the construction efficiency and reduce the cost.

Embodiment 2

Relative to the embodiment 1, the material selection of the longitudinal and transverse mounting strips herein is not typical at all. In this embodiment 1, the aluminum alloy material is selected for the longitudinal and transverse mounting strips, which results in lower heat insulation performance Relative to the embodiment 1. Others are the same as those of the embodiment 1.

Embodiment 3

Relative to the embodiment 2, in order to select the aluminum profile for the longitudinal and transverse mounting strips and improve the heat insulation performance, the outer heat resisting sheet may be arranged between the transverse mounting strip and transverse outer trim strip, a transverse inner heat resisting sheet is arranged between the transverse mounting strip and the transverse inner trim strip; a longitudinal outer heat resisting sheet is arranged between the longitudinal mounting strip and the longitudinal outer trim strip, a longitudinal inner heat resisting sheet is arranged between the longitudinal mounting strip and the longitudinal inner trim strip. Of course, the longitudinal mounting strip and the transverse mounting strip can also be wrapped with a plastic sheet respectively. Others are the same as those of the embodiment 2.

Embodiment 4

Figure 9:
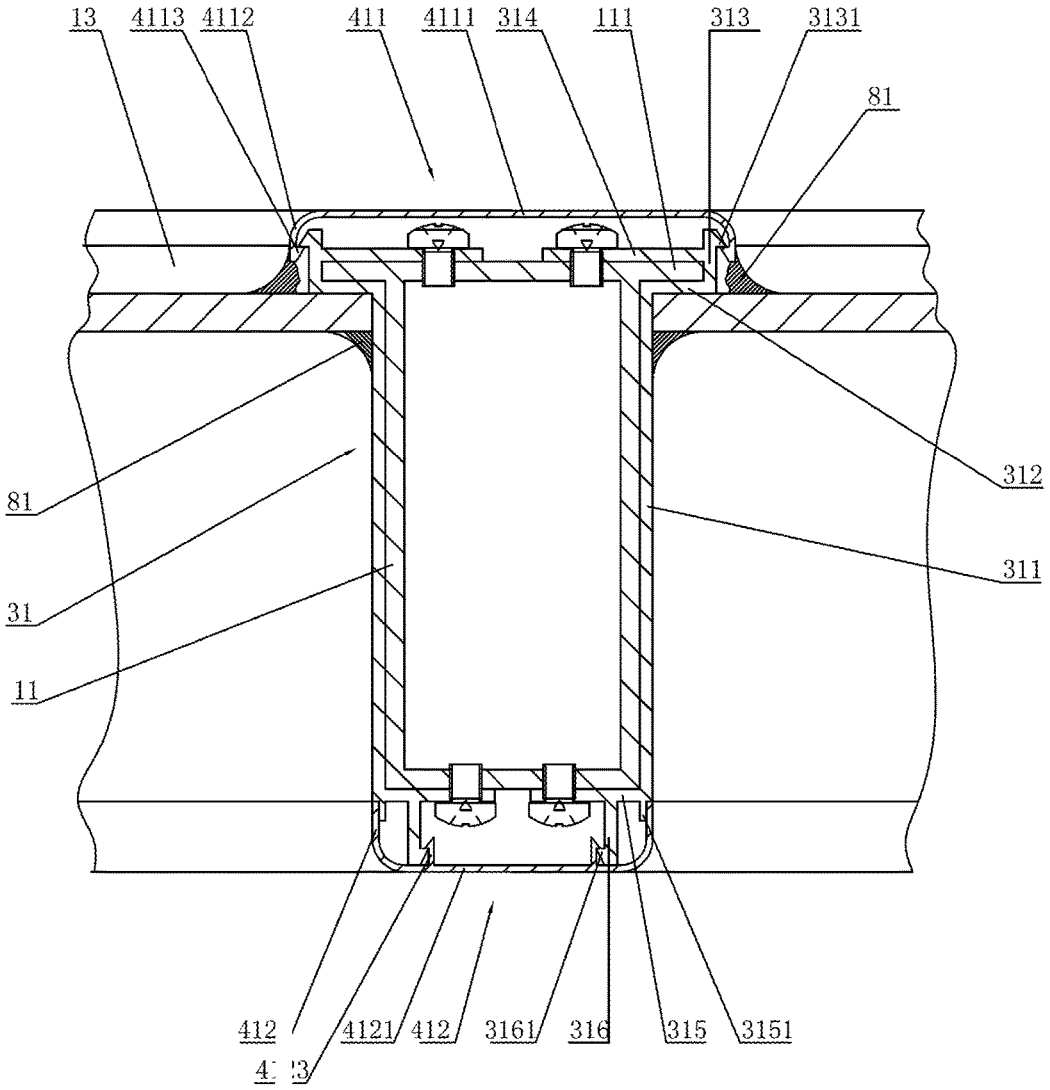
FIG. 9 is the structure diagram of the longitudinal keels, the longitudinal mounting strip, the longitudinal inner and outer trim strips of Embodiment 4.
Figure 10:
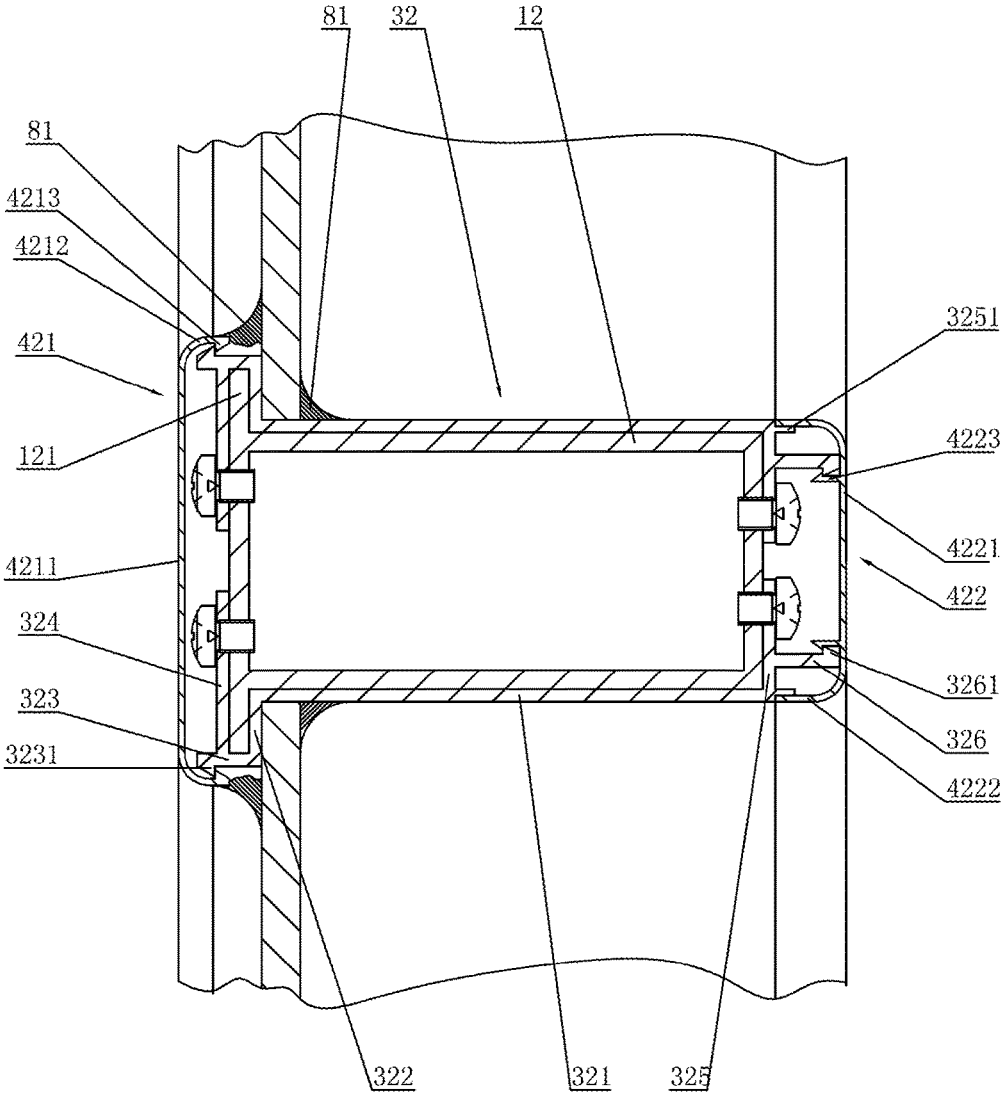
FIG. 10 is the structure diagram of the transverse keels, the transverse mounting strip, the transverse inner and outer trim strips of Embodiment 4.

As shown in FIG. 1, the wall comprises a main body comprising beams 101, uprights 102 and floor slabs 103, wherein the uprights 102 are formed between beams 101, and the floor slabs 103 and the beams 101 are mutually connected. As shown in FIG. 9 and FIG. 10, the wall also comprises keel frames 1 comprising more than two longitudinal keels 11 and more than two transverse keels 12, the keel frame 1 is installed in a space formed by the uprights 102 and the floor slabs 103, the longitudinal keels 11 on the left and right sides of the keel frame 1 located within the space are fixed to the inner side faces of the uprights 102, the uppermost and undermost transverse keels 12 are fixed to the inner side faces of the beams 101, and the said keel frame 1 can be either flush with or protrude from the outer surface of the beam 101. Cells 13 are formed between adjacent transverse keels 12 and adjacent longitudinal keels 11; the panel units 2 are installed in the Cell 13; a longitudinal mounting strip 31 is arranged between the longitudinal keel 11 and the panel unit 2, transverse mounting strips are arranged between the transverse keels 12 and the panel units 2.

As shown in FIG. 9, the outer edge of the longitudinal keel near the Cell extends to form longitudinal extending edge 111 toward the Cell, the longitudinal keel is in a hollow structure and made of a preferred iron material of higher toughness and strength. The transverse keel 12 is in a hollow structure. As shown in FIG. 10, the outer edge of the transverse keel near the Cell 13 extends to form a transverse extending edge 121 toward the Cell 13, the transverse keel is in a hollow structure and made of a preferred iron material of higher toughness and strength. The transverse keel is in a hollow structure.

As shown in FIG. 9, the longitudinal mounting strip 31 stretches across the longitudinal keel from indoor to outdoor, and the longitudinal mounting strip 31 comprises a longitudinal connecting edge 311, a longitudinal stopping edge 312 extending from the outer end of the longitudinal connecting edge 311 toward the Cell 13, a longitudinal outer stretching foot 313 extending from the longitudinal stopping edge 312 to the outside, a longitudinal outer mounting edge 314 extending from longitudinal outer stretching foot 313 toward the longitudinal keel 11, a longitudinal inner mounting edge 315 extending from the inner end of the longitudinal connecting edge 311 toward the longitudinal keel 11, and a longitudinal inner stretching foot 316 extending from the longitudinal inner mounting edge 315 to inside. A longitudinal clamping slot is formed between the longitudinal outer stopping edge and the longitudinal outer mounting edge 314. After the longitudinal mounting strip 31 is installed on the longitudinal keel 11, the longitudinal inner mounting edge 315 is stopped by the inner side face of the longitudinal keel 11 and fixed to the longitudinal keel 11 by screws. At the same time, the longitudinal extending edge 111 is clamped into the longitudinal clamping slot, the longitudinal outer mounting edge 314 is fixed to the outer side face of the longitudinal keel 11 by screws, and the longitudinal stopping edge 312 is stopped by the longitudinal extending edge 111. A longitudinal outer snap 3131 is arranged on the longitudinal outer stretching foot 313, and a longitudinal inner snap 3161 is arranged on the longitudinal inner stretching foot 316.

The longitudinal outer mounting edge 314 fixed to the longitudinal keel connected with the uprights 102 extends to the outside with a longitudinal connecting foot, and a longitudinal outer snap is arranged on the longitudinal connecting foot; the longitudinal inner mounting edge 315 fixed to the longitudinal keel connected with the uprights 102 extends to the outside with a longitudinal connecting foot, and a longitudinal outer snap is arranged on the longitudinal connecting foot.

A longitudinal inner decorative edge 4121 315 extends to the inside with a longitudinal positioning part 3151 positioned to the longitudinal inner trim strip.

The longitudinal mounting strip is a plastic par.

As shown in FIG. 10, the transverse mounting strips 32 stretches across the transverse keel 12 from indoor to outdoor, and the transverse mounting strips 32 comprises a transverse connecting edge, a transverse stopping edge 322 extending from the outer end of the transverse connecting edge 321 toward the Cell 13, a transverse outer stretching foot 323 extending from the transverse stopping edge 322 to the outside, a transverse outer mounting edge 324 extending from a transverse outer stretching foot 323 toward the transverse keel 12, a transverse inner mounting edge 325 extending from the inner end of the transverse connecting edge 321 toward the transverse keel 12, and a transverse inner stretching foot 326 extending from the transverse inner mounting edge 325 to inside. A transverse clamping slot is formed between the transverse outer stopping edge and the transverse outer mounting edge 324. After the transverse mounting strips 32 is installed on the transverse keel 12, the transverse inner mounting edge 325 is stopped by the inner side face of the transverse keel 12 and fixed to the transverse keel 12 by screws. At the same time, the transverse extending edge 121 is clamped into the transverse clamping slot, the transverse outer mounting edge 324 is fixed to the outer side face of the transverse keel 12 by screws, and the transverse stopping edge 322 is stopped by the transverse extending edge 121. A transverse outer snap 3231 is arranged on the transverse outer stretching foot 323, and a transverse inner snap 3261 is arranged on the transverse inner stretching foot 326.

The transverse outer mounting edge 324, which is fixed to the transverse keel connected with the beams 101, stretches to the outside with the transverse connecting foot, the transverse outer snap 3231 is arranged on the transverse connecting foot, the transverse inner mounting edge 325, which is fixed to the transverse keel connected with the beams 101, stretches to the outside with the transverse connecting foot, and the transverse outer snap is arranged on the transverse connecting foot.

As shown in FIG. 10, the transverse inner mounting edge 325 extends to the inside with a transverse positioning part 3251 positioned to the transverse inner trim strip 422.

The transverse mounting strips are a plastic part.

As shown in FIG. 9, the longitudinal outer trim strip 411 and the longitudinal inner trim strip 412 are respectively arranged outdoors and indoors in positions corresponding to the longitudinal keels 11. Prevent the case that an opening is to be provided in a position corresponding to the transverse keel after the longitudinal outer trim strip 411 is installed the inner surface of the longitudinal outer trim strip 411 is flush with or far away from the outer surface of the keel frame; prevent the case that an opening is to be provided in a position corresponding to the transverse keel after the longitudinal inner trim strip 412 is installed the outer surface of the longitudinal inner trim strip 412 is flush with or far away from the inner surface of the keel frame 1. The longitudinal outer trim strip 411 can be fixed by screws passing through the longitudinal keel. In order to fix the longitudinal outer trim strip 411 conveniently and reliably, a longitudinal projection is arranged in the middle part of the inner side of the longitudinal outer trim strip 411, namely the longitudinal outer trim strip 411 comprises a longitudinal outer decorative edge 4111, longitudinal projections are arranged in the longitudinal outer decorative extending edges connected to both ends of the longitudinal outer decorative edge 4111 and extending in the same direction and longitudinal projections in the middle part of the inner side of the longitudinal outer trim strip 411, and the longitudinal outer positioning strip is arranged at the inner side face of the longitudinal outer trim strip 411. After the longitudinal outer trim strip 411 is installed, the longitudinal outer trim strip 411 contacts with the longitudinal mounting strip, the longitudinal outer positioning strip is located at the inner side of the longitudinal outer stretching foot, and meanwhile, no longitudinal outer snap is to be provided on the longitudinal outer stretching foot.

As shown in FIG. 9, the longitudinal outer trim strips 411 not on the longitudinal keel fixed to the upright comprises the longitudinal outer decorative edge 4111, the longitudinal outer decorative extending edges 4112 connected to both ends of the longitudinal outer decorative edge 4111 and extending in the same direction and a longitudinal outer trim strips snap 4113 arranged at the inner side of the longitudinal outer decorative extending edge. The longitudinal outer trim strips snap 4113 is clamped to the longitudinal outer snap 3131 on the longitudinal mounting strips on both sides of the corresponding longitudinal keel, so that the longitudinal outer trim strips 411 is fixed to the longitudinal mounting strip 31. The longitudinal outer trim strips 411 on the longitudinal keel fixed to the upright comprises a longitudinal outer decorative edge, the longitudinal outer decorative extending edges connected to both ends of the longitudinal outer decorative edge and extending in the same direction, the longitudinal outer trim strips snap arranged at the inner side of the longitudinal outer decorative extending edge, and a longitudinal decorative item outer stopping edge extending from one end of the longitudinal outer decorative edge to the upright direction. Corresponding to the longitudinal keel installed to the upright, the longitudinal outer trim strips snap on its corresponding longitudinal outer trim strips is clamped to the longitudinal outer snap on the same longitudinal mounting strip and the longitudinal outer snap on the longitudinal connecting foot.

As shown in FIG. 9, the longitudinal inner trim strip 412 not on the longitudinal keel fixed to the upright comprises the longitudinal inner decorative edge 4121, the longitudinal inner decorative extending edges connected to both ends of the longitudinal inner decorative edge 4121 and extending in the same direction and a longitudinal inner trim strip snap 4123 arranged on the longitudinal inner decorative extending edge. The longitudinal inner trim strip snap 4123 is clamped to the longitudinal inner snap 3161 on the longitudinal mounting strips on both sides of the corresponding longitudinal keel, so that the longitudinal inner trim strip 412 is fixed to the longitudinal mounting strip. As shown in FIG. 7, the longitudinal inner trim strip 412 on the longitudinal keel fixed to the upright comprises a longitudinal inner decorative edge 4121, a longitudinal inner decorative extending edge 4122 connected to one end of the longitudinal inner decorative edge 4121, the longitudinal inner trim strip snap 4123 arranged on the longitudinal inner decorative edge 4121, and a longitudinal decorative item inner stopping edge 4124 extending from one end of the longitudinal inner decorative edge 4121 to the upright direction. Corresponding to the longitudinal keel 11 installed to the upright, the longitudinal inner trim strip snap 4123 on its corresponding longitudinal inner trim strip 412 is clamped to the longitudinal inner snap 3161 on the same longitudinal mounting strip and the longitudinal inner snap on the longitudinal connecting foot.

As shown in FIG. 10, the transverse outer trim strip 421 and the transverse inner trim strip 422 are respectively arranged outdoors and indoors in positions corresponding to transverse keel. The inside surface of the transverse outer trim strip 421 is flush with or far away from the outer surface of the keel frame 1 to prevent the provision of an opening in the position of the longitudinal keel after the transverse outer trim strip 421 is installed; the outer surface of the transverse inner trim strip 422 is flush with or far away from the inside surface of the keel frame to prevent the provision of an opening in the position of the longitudinal keel after the transverse inner trim strip 422 is installed. The transverse outer trim strip 421 may be fixed by screws passing through the transverse keel. In order to fix the transverse outer trim strip conveniently and reliably, the transverse projection is arranged in the middle part of the inner side of the transverse outer trim strip, namely that the transverse outer trim strip comprises a transverse outer decorative edge 4211, transverse outer decorative extending edges 4212 connected to both ends of the transverse outer decorative edge 4211 and extending in the same direction, and a transverse projection arranged in the middle part of the inner side of the transverse outer trim strip, wherein a transverse outer positioning strip is arranged at the inner side face of the transverse outer trim strip. After the transverse outer trim strip is installed, the transverse outer trim strip contacts with the transverse mounting strip, and the transverse outer positioning strip is located at the inner side of the transverse outer stretching foot. Meanwhile, no transverse outer snap 3231 is to be provided on the transverse outer stretching foot.

As shown in FIG. 4, the transverse outer trim strip 421 not on the transverse keel 12 fixed to the beam 101 comprises the transverse outer decorative edge 4211, the transverse outer decorative extending edges 4212 connected to both ends of the transverse outer decorative edge 4211 and extending in the same direction and a transverse inner trim strip snap 4223 4213 arranged at the inner side of the transverse outer decorative extending edge. The transverse inner trim strip snap 4223 4213 is clamped to the transverse outer snap 3231 on the transverse mounting strips on both sides of the corresponding transverse keel, so that the transverse outer trim strip is fixed to the transverse mounting strip. As shown in FIG. 8, the transverse outer trim strip 421 on the transverse keel fixed to the beam comprises the transverse outer decorative edge, the transverse outer decorative extending edges connected to both ends of the transverse outer decorative edge and extending in the same direction, the transverse inner trim strip snap 4223 arranged at the inner side of the transverse outer decorative extending edge, and the transverse decorative item outer stopping edge extending from one end of the transverse outer decorative edge to the direction of the beam 101. Corresponding to the transverse keel installed to the beam 101, the transverse inner trim strip snap 4223 on its corresponding transverse outer trim strip is clamped to the transverse outer snap 3231 on the same transverse mounting strips and the transverse outer snap on the transverse connecting foot.

As shown in FIG. 10, the transverse inner trim strip 422 not on the transverse keel 12 fixed to the beam 101 comprises a transverse inner decorative edge 4221, the transverse inner decorative extending edges 4222 connected to both ends of the transverse inner decorative edge 4221 and extending in the same direction, and a transverse inner trim strip snap 4223 arranged on the transverse inner decorative edge 4221. The transverse inner trim strip snap 4223 is clamped to the transverse inner snap 3261 on the transverse mounting strips on both sides of the corresponding transverse keel 12, so that the transverse inner trim strip 422 is fixed to the transverse mounting strip. The transverse inner trim strip 422 on the transverse keel fixed to the beam 101 comprises the transverse inner decorative edge, a transverse inner decorative extending edge connected to one end of the transverse inner decorative edge, a transverse inner trim strip snap arranged on the transverse inner decorative edge, and a transverse decorative item inner stopping edge extending from one end of the transverse inner decorative edge to the direction of the beam 101. Corresponding to the transverse keel installed to the beam 101, the transverse inner trim strip snap on its corresponding transverse inner trim strip is clamped to the transverse inner snap on the same transverse mounting strips and the transverse inner snap on the transverse connecting foot.

The transverse inner and outer trim strips and the longitudinal inner and outer trim strips are made of aluminum alloy or plastic decorative items are provided both outdoors and indoors in positions corresponding to the uprights, wherein each decorative item comprises fixed parts and intermediate decorative parts linking the fixed parts; the fixed parts are fixed to the longitudinal keels located at both sides of the upright; the fixed part located outdoors is stopped or covered by the outer stopping edge of the longitudinal decorative item; the fixed part located indoors is stopped or covered by the longitudinal decorative item inner stopping edge; the intermediate decorative part is tabular, semicircular or square, or in the shape of a roman column.

Decorative items are provided both outdoors and indoors in positions corresponding to the beams, wherein each decorative item comprises fixed parts and intermediate decorative parts linking the fixed parts; the fixed parts are fixed to the transverse keels located at both sides of the beam; the fixed part located outdoors is stopped or covered by the transverse decorative item outer stopping edge; the fixed part located indoors is stopped or covered by the transverse decorative item inner stopping edge; the intermediate decorative part is tabular, semicircular or square, or in the shape of a roman column.

The panel unit 2 is a single-layered panel that is a glass plate, a metal plate, an inorganic material plate or an organic material plate etc.

After the single-layered panel is installed inside each Cell, the edges of the single-layered panel are stopped by the longitudinal stopping edges 312 and the transverse stopping edges 322. There is sealant between the inner surface of the single-layered panel, the longitudinal mounting strip and the transverse mounting strip.

As shown in FIG. 9 and FIG. 10, in order to improve the sealing and thermal insulation performances, sealant 81 is provided between the outer surface of the single-layered panel and the longitudinal outer trim strips 411, between the outer surface of the single-layered panel and the transverse outer trim strip 421, between the inner surface of the single-layered panel and the longitudinal mounting strips 31 and between the inner surface of the single-layered panel and the transverse mounting strip 32.

In this embodiment, if in the wall windows need to be installed in the wall, the existing sliding window or casement window may be directly installed in the Cell.

The construction method for the above wall is as follows.

(1) Set the keel frames 1 comprising more than two transverse keels 12 and more than two longitudinal keels 11 into a space comprising the uprights 102 and beams 101, fix the upper and lower two transverse keels 12 to the inner side faces of the beams 101, and fix the outermost two longitudinal keels 11 to the inner side faces of the uprights 102; the outer surface of the keel frame is flush with or protrudes from the outer surface of the beam; a Cell 13 is formed between adjacent transverse keels and adjacent longitudinal keels;

(2) Install the longitudinal mounting strip 31 fixed to and stretching across the longitudinal keel 11 in the Cell 13 in which the panel units 2 needs to be installed; install the transverse mounting strips 32 fixed to and stretching across the transverse keel 12 in the Cell 13 in which the panel units 2 needs to be installed;

(3) Install the single-layered panel in the Cell from indoor to outdoor in the Cell where the single-layered panel needs to be installed, and stop the edge of the single-layered panel from the longitudinal stopping edge 312 and the transverse stopping edge 322; apply sealant 81 respectively between the single-layered panel and the transverse mounting strips and between the single-layered panel and the longitudinal mounting strip;

(4) Set the longitudinal inner trim strip 412 clamped to the longitudinal mounting strip 31 in an indoor position corresponding to the longitudinal keel 11; Set the transverse inner trim strip 422 clamped to the transverse mounting strips 32 in an indoor position corresponding to the transverse keel 12;

(5) Fix the decorative items in outdoor positions corresponding to the uprights 102 and beams 101;

(6) Provide the longitudinal outer trim strips 411 clamped to the longitudinal outer snap in an outdoor position corresponding to the longitudinal keel 11; provide the transverse outer trim stripm 421 clamped to the transverse outer snap in an outdoor position corresponding to the transverse keel 12;

(7) Apply sealant 81 between the single-layered panel and the longitudinal outer trim strips 411 and between the single-layered panel and the transverse trim strip;

(8) If windows need to be installed in the wall, the existing sliding window or casement window may be installed in the Cell without the panel unit. The sliding window comprises a frame body and glass arranged in the frame body, wherein the frame body is arranged between two adjacent transverse keels through guide rails. The casement window comprises an outer frame body and an inner frame body, wherein the outer frame body is fixed in the Cell, and the middle parts at both sides of the inner frame body are interconnected to longitudinal keel at two adjacent sides by a connecting rod.

In this embodiment, due to the provision of the longitudinal extending edge 111 and the transverse extending edge 121, the longitudinal extending edge 111 and the transverse extending edge 121 play a main role of force bearing, and the longitudinal stopping edge 312 and the transverse stopping edge 322 mainly play a role of isolation. In this way, the strength for resisting the panel unit is high, and the panel unit is fixed firmly and reliably. Since the keel frame 1 is wrapped by the longitudinal and transverse mounting strips, longitudinal and transverse outer trim strips and longitudinal and transverse inner trim strips, there is no exposed part of the keel frame 1. In this way, the waterproof and dustproof performance for the keel frame is good, and the protection performance for the keel frame is good. Therefore, a low cost, good toughness and good strength iron material may be selected for the keel frame during wall building. In this way, not only the wall strength can be guaranteed, but also the wall cost can be reduced. In addition, in the description, the longitudinal and transverse mounting strips use plastic parts having good heat insulation effect, the longitudinal and transverse outer trim strips are directly clamped to the longitudinal and transverse mounting strips, and the longitudinal and transverse inner trim strips are directly clamped to the longitudinal and transverse mounting strips. In this structure, the longitudinal and transverse mounting strips not only play the role of the fixed panel unit and the fixed inner and outer trim strips, but also play the role of an insulated bridge so that the wall has good heat insulation effect. In this embodiment, either aluminum profile or plastic part is recommended for the inner and outer trim strips. The wall has the advantage of simple structure and construction method, and therefore, the wall can improve the construction efficiency and reduce the cost.

Embodiment 5

Relative to the embodiment 4, the material selection of the longitudinal and transverse mounting strips herein is not typical at all. In this embodiment 1, the aluminum alloy material is selected for the longitudinal and transverse mounting strips, which results in lower heat insulation performance relative to the embodiment 4. Others are the same as those of the embodiment 4.

Embodiment 6

Relative to the embodiment 5, in order to select the aluminum profile for the longitudinal and transverse mounting strips and improve the heat insulation performance, the outer heat resisting sheet may be arranged between the transverse mounting strip and transverse outer trim strip, a transverse inner heat resisting sheet is arranged between the transverse mounting strip and the transverse inner trim strip; a longitudinal outer heat resisting sheet is arranged between the longitudinal mounting strip and the longitudinal outer trim strip, a longitudinal inner heat resisting sheet is arranged between the longitudinal mounting strip and the longitudinal inner trim strip. Of course, the longitudinal mounting strip and the transverse mounting strip can also be wrapped with a plastic sheet respectively. Others are the same as those of the embodiment 5.

Embodiment 7

Figure 11:
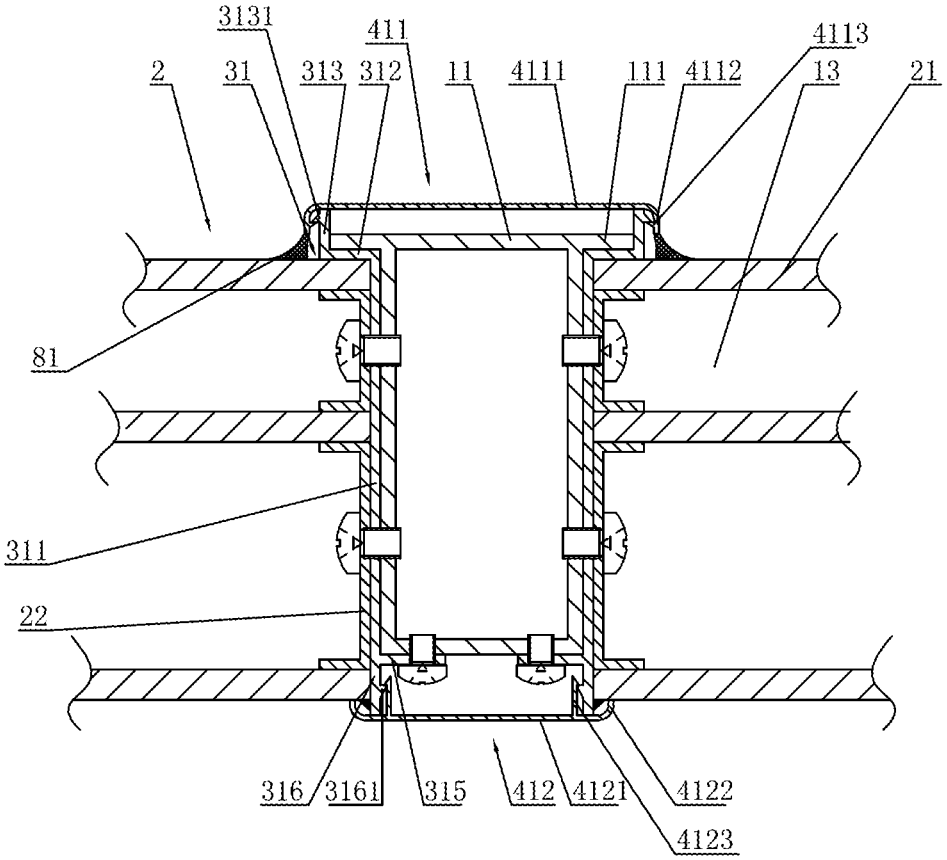
FIG. 11 is the structure diagram of the longitudinal keels, the longitudinal mounting strip, the longitudinal inner and outer trim strips of Embodiment 7.
Figure 12:
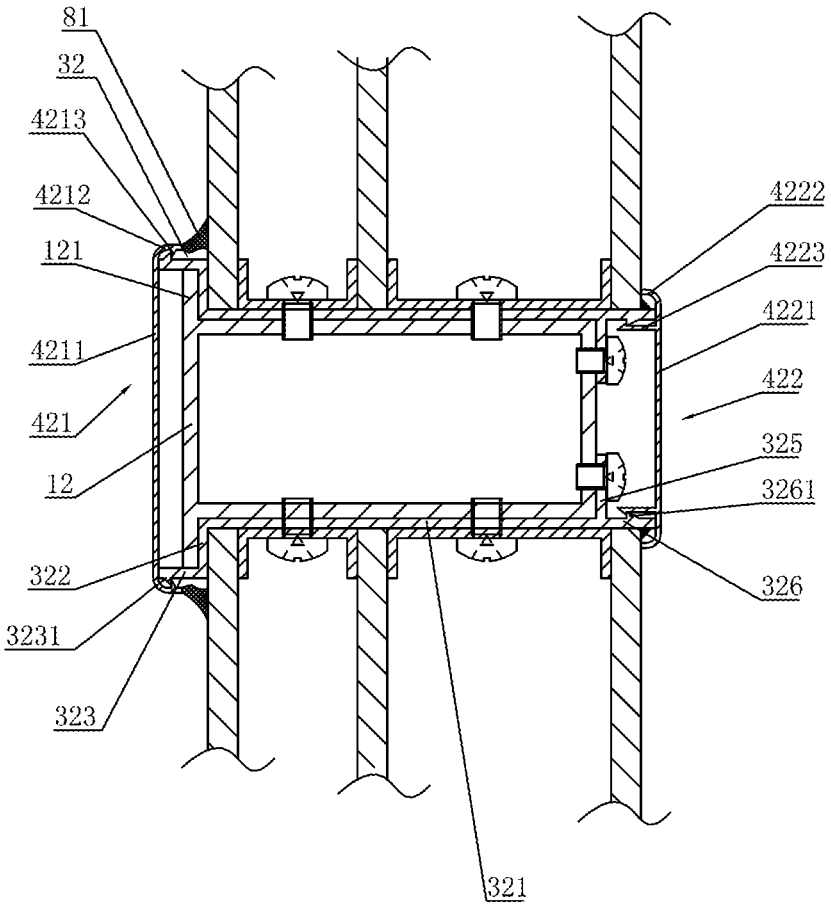
FIG. 12 is the structure diagram of the transverse keels, the transverse mounting strip, the transverse inner and outer trim strips of Embodiment 7.
Figure 13:
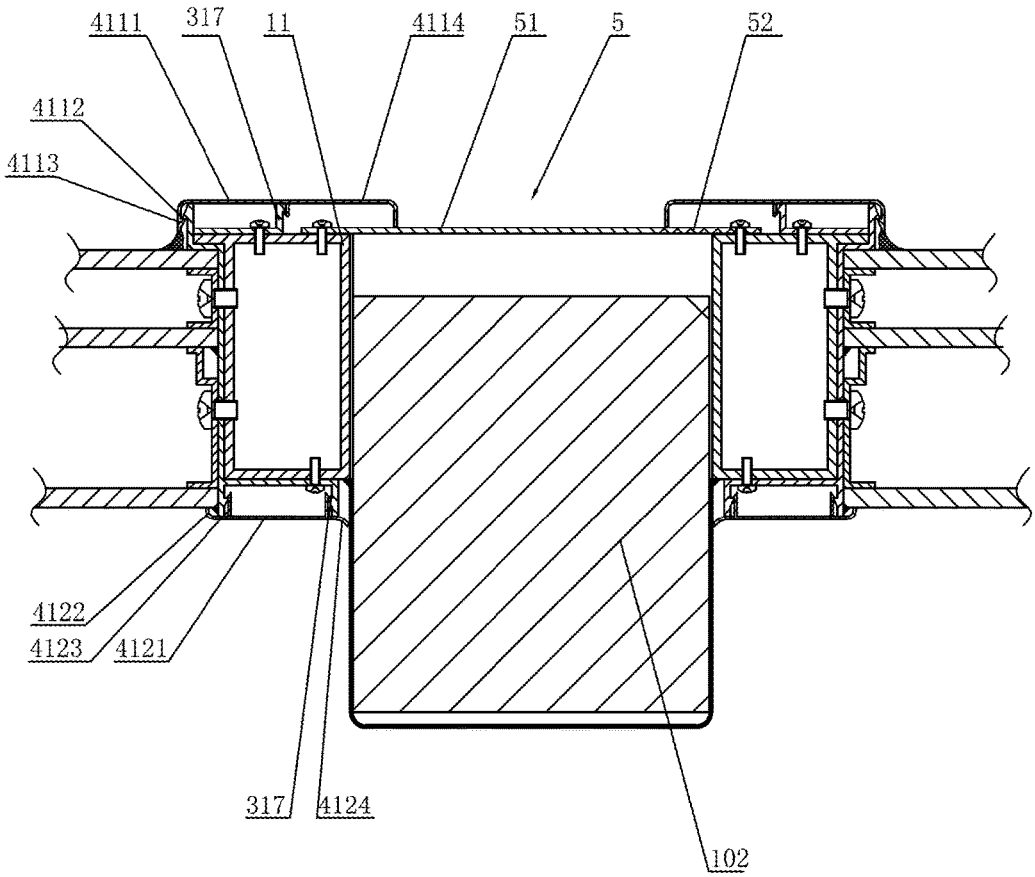
FIG. 13 is the structure diagram of the longitudinal keels installed together with the uprights of Embodiment 7.
Figure 14:
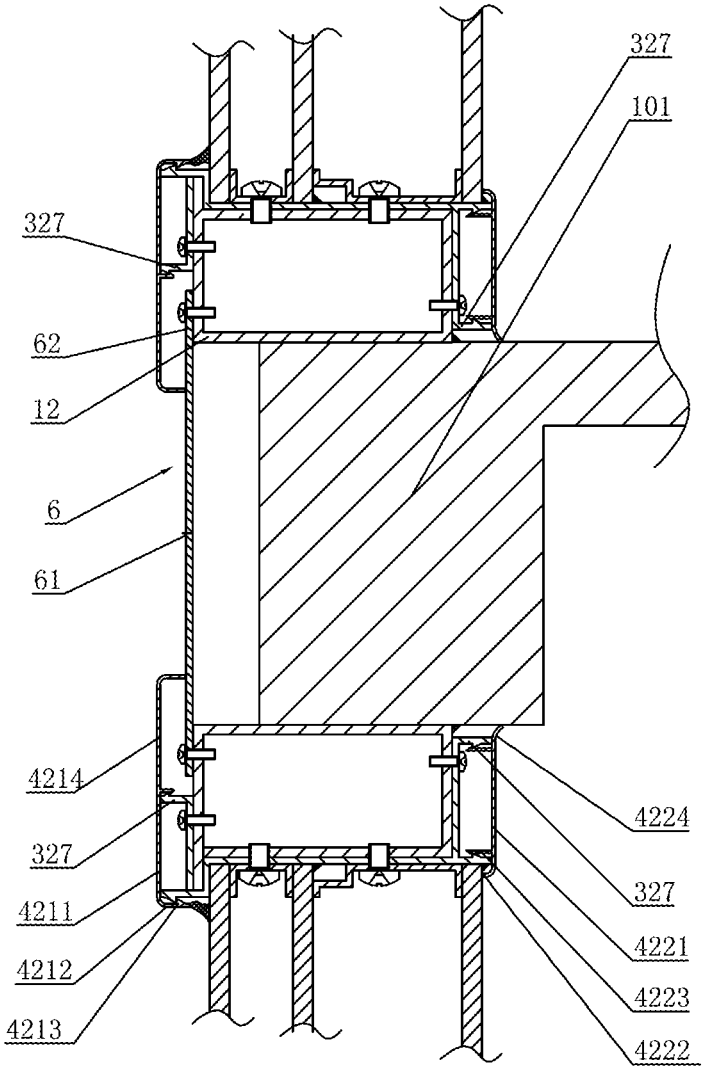
FIG. 14 is the structure diagram of the transverse keels installed together with the beams of Embodiment 7.

As shown in FIG. 1, the wall comprises a main body comprising beams 101, uprights 102 and floor slabs 103, wherein the uprights 102 are formed between beams 101, and the floor slabs 103 and the beams 101 are mutually connected. As shown in FIG. 1, FIG. 11 and FIG. 12, the wall also comprises a keel frame 1 comprising more than two longitudinal keels 11 and more than two transverse keels 12, the keel frame 1 is installed in a space formed by the uprights 102 and the floor slabs 103, the longitudinal keels 11 on the left and right sides of the keel frame 1 located within the space are fixed to the inner side faces of the uprights 102, the uppermost and undermost transverse keels 12 are fixed to the inner side faces of the beams 101, and the said keel frame 1 can be flush with the outer surface of the beam 101. As shown in FIG. 13 and FIG. 14, the said keel frame 1 can be protrude from the outer surface of the beam 101. Cells are formed between adjacent transverse keels 12 and adjacent longitudinal keels 11; the panel units 2 are installed in the cell; a longitudinal mounting strip 31 is arranged between the longitudinal keel 11 and the panel unit 2, transverse mounting strips are arranged between the transverse keels 12 and the panel units 2.

As shown in FIG. 11, the outer edge of the longitudinal keel near the Cell extends to form longitudinal extending edge 111 toward the cell, the longitudinal keel is in a hollow structure and made of a preferred iron material of higher toughness and strength. The transverse keel is in a hollow structure. The outer edge of the transverse keel near the Cell 13 extends to form a transverse extending edge 121 toward the cell, the transverse keel is in a hollow structure and made of a preferred iron material of higher toughness and strength. The transverse keel is in a hollow structure.

The longitudinal mounting strip 31 stretches across the longitudinal keel 11 from indoor to outdoor, and the longitudinal mounting strip 31 comprises a longitudinal connecting edge 311, a longitudinal stopping edge 312 extending from the outer end of the longitudinal connecting edge 311 toward the cell, a longitudinal outer stretching foot 313 extending from the longitudinal stopping edge 312 to the outside, a longitudinal inner mounting edge 315 extending from the inner end of the longitudinal connecting edge 311 toward the longitudinal keel 11, and a longitudinal inner stretching foot 316 extending from the longitudinal inner mounting edge 315 to inside; of course, in order to improve the fixing firmness of the longitudinal mounting strip 31 and the bearing strength of the longitudinal stopping edge 312, from the longitudinal outer stretching foot 313 to the direction of the longitudinal keel 11 can be extended with the longitudinal outer mounting edge can extend, and the longitudinal outer mounting edge is fixed to the longitudinal keel 11 by screws. After the longitudinal mounting strip 31 is installed on the longitudinal keel 11, the longitudinal inner mounting edge 315 is stopped by the inner side face of the longitudinal keel 11, the longitudinal inner mounting edge 315 is fixed to the inner side face of the longitudinal keel 11 by screws, and the longitudinal stopping edge 312 is stopped by the longitudinal extending edge 111.

As shown in FIG. 13, the longitudinal mounting strip 31 fixed to the longitudinal keel connected with the uprights 102 extends to the outside with the longitudinal connecting foot 317, and a longitudinal outer snap 3131 is arranged on the longitudinal connecting foot 317; the longitudinal linner mounting edge 315 fixed to the longitudinal keel 11 connected with the uprights 102 extends to the outside with a longitudinal connecting foot 317, and a longitudinal outer snap 3131 is arranged on the longitudinal connecting foot 317.

The longitudinal mounting strip is a plastic par.

As shown in FIG. 12, the transverse mounting strip stretches across the transverse keel 12 from indoor to outdoor, and the transverse mounting strip comprises a transverse connecting edge 321, a transverse stopping edge 322 extending from the outer end of the transverse connecting edge 321 toward the cell, a transverse outer stretching foot 323 extending from the transverse stopping edge 322 to the outside, a transverse inner mounting edge 325 extending from the inner end of the transverse connecting edge 321 toward the transverse keel 12, and a transverse inner stretching foot 326 extending from the transverse inner mounting edge 325 to inside; Of course, in order to improve the fixing firmness of the transverse mounting strip and the bearing firmness of the transverse stopping edge 322, from the transverse outer extending foot to the direction of the transverse keel 12 can be extend with the transverse outer mounting edge, and the transverse outer mounting edge is fixed to the outer surface of the transverse keel 12 by screws. After the transverse mounting strip is installed on the transverse keel 12, the transverse inner mounting edge 325 is stopped by the inner side face of the transverse keel 12 and fixed to the transverse keel 12 by screws. The transverse stopping edge 322 is stopped by the transverse extending edge 121. A transverse outer snap 3231 is arranged on the transverse outer stretching foot 323, and a transverse inner snap 3261 is arranged on the transverse inner stretching foot.

As shown in FIG. 14, the transverse mounting strip fixed to the transverse keel 12 connected with the beams 101 extend to the outside with the transverse connecting foot 327. which is fixed to the transverse keel 12 connected with the beams 101, stretches to the outside with the transverse connecting foot 327, and the transverse outer snap 3231 is arranged on the transverse connecting foot 327; the transverse inner mounting edge 325, which is fixed to the transverse keel 12 connected with the beams 101, stretches to the outside with the transverse connecting foot 327, and the transverse outer snap 3231 is arranged on the transverse connecting foot 327.

The transverse mounting strip is a plastic part.

As shown in FIG. 11, the longitudinal outer trim strip 411 and the longitudinal inner trim strip 412 are respectively arranged outdoors and indoors in positions corresponding to the longitudinal keels. Prevent the case that an opening is to be provided in a position corresponding to the transverse keel after the longitudinal outer trim strip 411 is installed the inner surface of the longitudinal outer trim strip 411 is flush with or far away from the outer surface of the keel frame 1; prevent the case that an opening is to be provided in a position corresponding to the transverse keel after the longitudinal inner trim strip 412 is installed the outer surface of the longitudinal inner trim strip 412 is flush with or far away from the inner surface of the keel frame.

As shown in FIG. 11, the longitudinal outer trim strips not on the longitudinal keel fixed to the upright comprises the longitudinal outer decorative edge 4111, the longitudinal outer decorative extending edges 4112 connected to both ends of the longitudinal outer decorative edge 4111 and extending in the same direction and a longitudinal outer trim strip snap 4113 arranged at the inner side of the longitudinal outer decorative extending edge. The longitudinal outer trim strip snap 4113 is clamped to the longitudinal outer snap 3131 on the longitudinal mounting strips on both sides of the corresponding longitudinal keel, so that the longitudinal outer trim strip 411 is fixed to the longitudinal mounting strip. As shown in FIG. 13, the longitudinal outer trim strip 411 on the longitudinal keel fixed to the upright comprises a longitudinal outer decorative edge 4111, the longitudinal outer decorative extending edges 4112 connected to both ends of the longitudinal outer decorative edge 4111 and extending in the same direction, the longitudinal outer trim strip snap 4113 arranged at the inner side of the longitudinal outer decorative extending edge, and a longitudinal decorative item outer stopping edge 4214 extending from one end of the longitudinal outer decorative edge 4111 to the upright 102 direction. Corresponding to the longitudinal keel 11 installed to the upright, the longitudinal outer trim strip snap 4113 on its corresponding longitudinal outer trim strip 411 is clamped to the longitudinal outer snap 3131 on the same longitudinal mounting strip 31 and the longitudinal outer snap on the longitudinal connecting foot 317.

Figure 15:
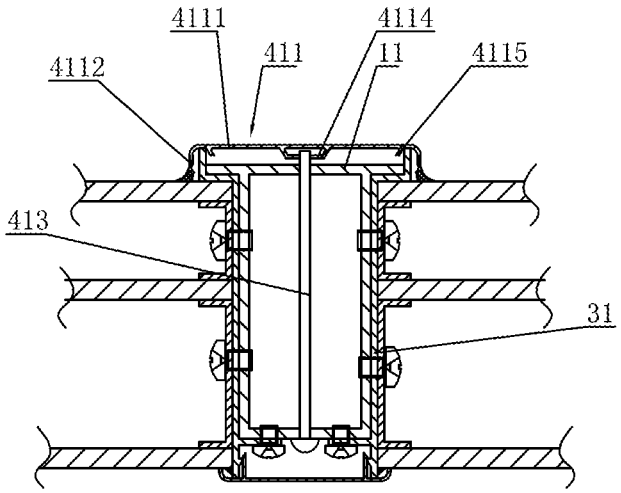
FIG. 15 is the structure diagram of the longitudinal outer trim strips fixed by the longitudinal screws.

As shown in FIG. 15, the longitudinal outer trim strip 411 may be fixed by the longitudinal screws 413 passing through the longitudinal keel, in order to fix the longitudinal outer trim strip 411 conveniently and reliably, a longitudinal projection 4114 is arranged in the middle part of the inner side of the longitudinal outer trim strip, namely the longitudinal outer trim strip 411 comprises a longitudinal outer decorative edge 4111, longitudinal projections 4114 are arranged in the longitudinal outer decorative extending edges 4112 connected to both ends of the longitudinal outer decorative edge 4111 and extending in the same direction and in the middle part of the inner side of the longitudinal outer trim strip 411 the longitudinal outer decorative extending edges 4112 connected to both ends of the longitudinal outer decorative edge 4111 and extending in the same direction and longitudinal projections 4114 in the middle part of the inner side of the longitudinal outer trim strip, and the longitudinal outer positioning strip 4115 is arranged at the inner side face of the longitudinal outer trim strip. After the longitudinal outer trim strip 411 is installed, the longitudinal outer trim strip 411 contacts with the longitudinal mounting strip 31, the longitudinal outer positioning strip 4115 is located at the inner side of the longitudinal outer stretching foot, playing the role of positioning, and meanwhile, no longitudinal outer snap is to be provided on the longitudinal outer stretching foot.

As shown in FIG. 11, the longitudinal inner trim strip 412 not on the longitudinal keel fixed to the upright comprises the longitudinal inner decorative edge 4121, the longitudinal inner decorative extending edges 4122 connected to both ends of the longitudinal inner decorative edge 4121 and extending in the same direction and a longitudinal inner trim strip snap 4123 arranged on the longitudinal outer inner decorative extending edge. The longitudinal inner trim strip snap 4123 is clamped to the longitudinal inner snap 3161 on the longitudinal mounting strips on both sides of the corresponding longitudinal keel, so that the longitudinal inner trim strip 412 is fixed to the longitudinal mounting strip. As shown in FIG. 13, the longitudinal inner trim strip 412 on the longitudinal keel fixed to the upright comprises a longitudinal inner decorative edge 4121, a longitudinal inner decorative extending edge 4122 connected to one end of the longitudinal inner decorative edge 4121, the longitudinal inner trim strip snap 4123 arranged on the longitudinal inner decorative edge 4121, and a longitudinal decorative item 5 inner stopping edge 4124 extending from one end of the longitudinal inner decorative edge 4121 to the upright 102 direction. Corresponding to the longitudinal keel 11 installed to the upright, the longitudinal inner trim strip snap 4123 on its corresponding longitudinal inner trim strip 412 is clamped to the longitudinal inner snap 3161 on the same longitudinal mounting strip and the longitudinal inner snap 3161 on the longitudinal connecting foot 317.

As shown in FIG. 12, the transverse outer trim strip 421 and the transverse inner trim strip 422 are respectively arranged outdoors and indoors in positions corresponding to transverse keel. The inside surface of the transverse outer trim strip 421 is flush with or far away from the outer surface of the keel frame to prevent the provision of an opening in the position of the longitudinal keel after the transverse outer trim strip 421 is installed; the outer surface of the transverse inner trim strip 422 is flush with or far away from the inside surface of the keel frame to prevent the provision of an opening in the position of the longitudinal keel after the transverse inner trim strip 422 is installed. The transverse outer trim strip 421 may be fixed by screws passing through the transverse keel. As shown in FIG. 12, the transverse outer trim strip 421 not on the transverse keel fixed to the beam 101 comprises the transverse outer decorative edge 4211, the transverse outer decorative extending edges 4212 connected to both ends of the transverse outer decorative edge 4211 and extending in the same direction and a transverse outer trim strip snap 4213 arranged at the inner side of the transverse outer decorative extending edge 4212. The transverse outer trim strip snap 4213 is clamped to the transverse outer snap 3231 on the transverse mounting strips on both sides of the corresponding transverse keel, so that the transverse outer trim strip 421 is fixed to the transverse mounting strip. As shown in FIG. 14, the transverse outer trim strip 421 on the transverse keel 12 fixed to the beam 101 comprises the transverse outer decorative edge 4211, the transverse outer decorative extending edges 4212 connected to both ends of the transverse outer decorative edge 4211 and extending in the same direction, the transverse outer trim strip snap 4213 arranged at the inner side of the transverse outer decorative extending edge 4212, and the transverse decorative item 5 outer stopping edge 4214 extending from one end of the transverse outer decorative edge 4211 to the direction of the beam 101. Corresponding to the transverse keel 12 installed to the beam 101, the transverse outer trim strip snap 4213 on its corresponding transverse outer trim strip 421 is clamped to the transverse outer snap 3231 on the same transverse mounting strip and the transverse outer snap on the transverse connecting foot 327.

Figure 16:
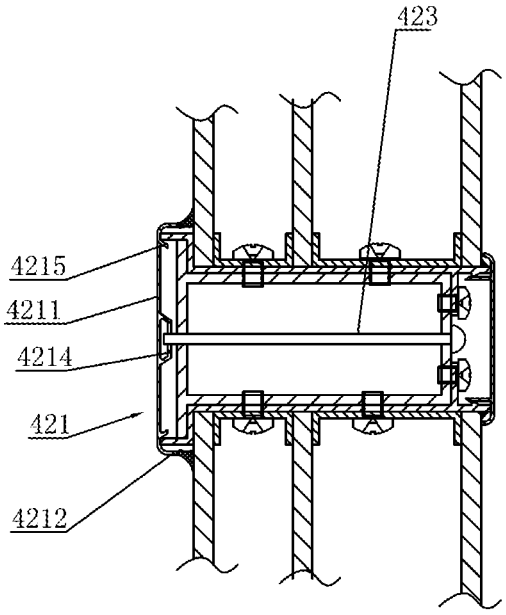
FIG. 16 is the structure diagram of the transverse outer trim strips fixed by the transverse screws.
Figure 17:
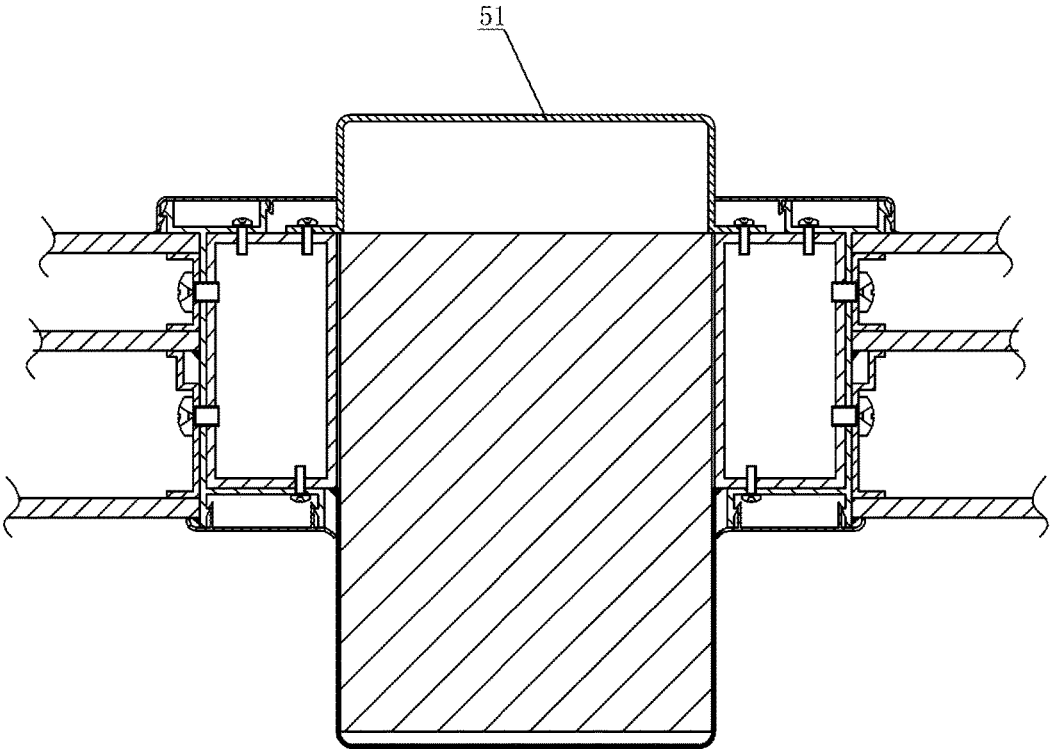
FIG. 17 is the structure diagram of an intermediate decorative part of the decorative items.
Figure 18:
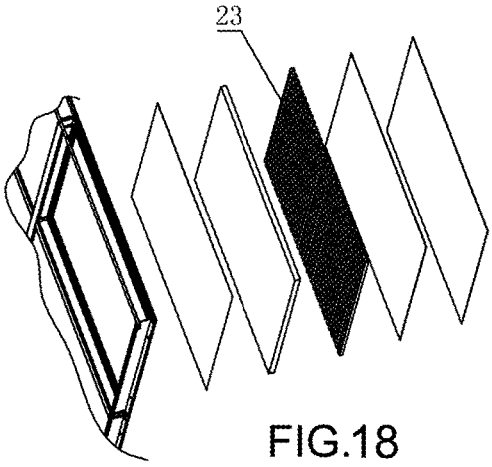
FIG. 18 is the structure diagram of the corrugated plate being installed between two adjacent panels.
Figure 19:
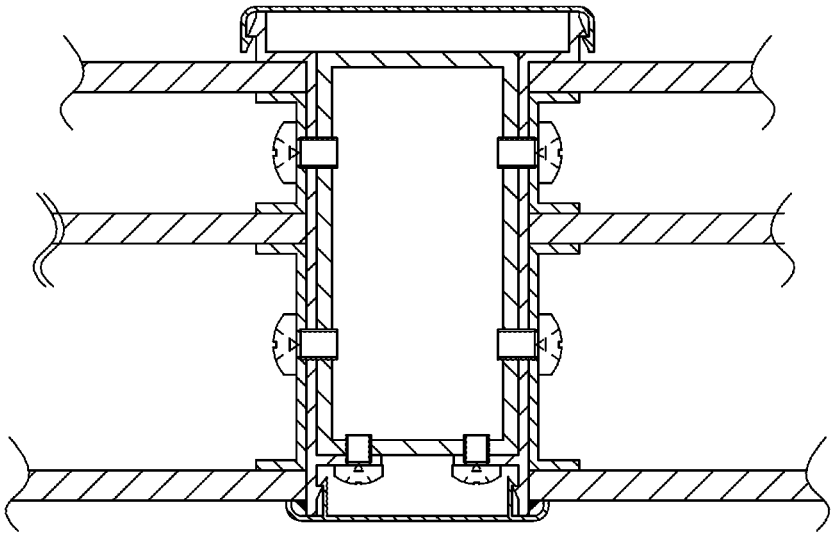
FIG. 19 is the structure diagram of the longitudinal keels, the longitudinal mounting strip, the longitudinal inner and outer trim strips of Embodiment 16.
Figure 20:
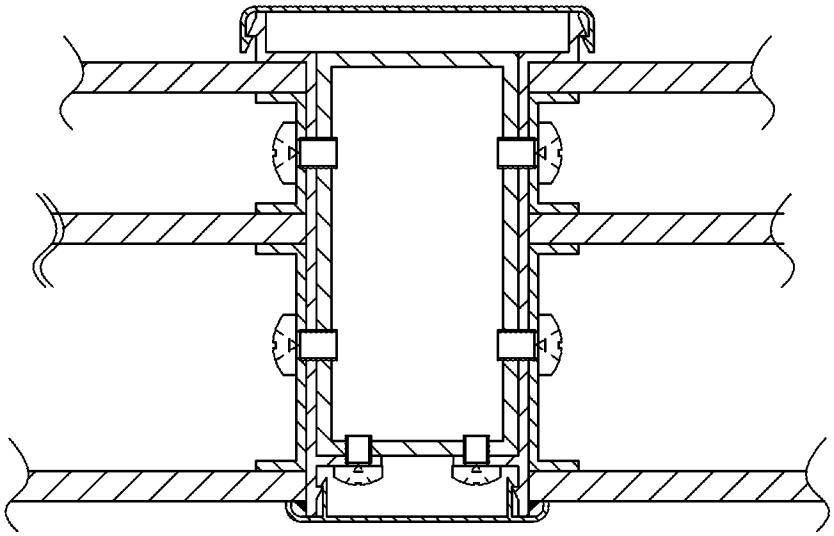
FIG. 20 is the structure diagram of the transverse keels, the transverse mounting strip, the transverse inner and outer trim strips of Embodiment 16.

As shown in FIG. 16, the transverse outer trim strip can be fixed by the transverse screws passing through the transverse keel. In order to fix the transverse outer trim strip conveniently and reliably, the transverse projection 4214 is arranged in the middle part of the inner side of the transverse outer trim strip, namely that the transverse outer trim strip comprises a transverse outer decorative edge, transverse outer decorative extending edges connected to both ends of the transverse outer decorative edge and extending in the same direction, and a transverse projection 4214 arranged in the middle part of the inner side of the transverse outer trim strip, wherein a transverse outer positioning strip 4215 is arranged at the inner side face of the transverse outer trim strip. After the transverse outer trim strip is installed, the transverse outer trim strip contacts with the transverse mounting strip, and the transverse outer positioning strip 4215 is located at the inner side of the transverse outer stretching foot, playing the role of positioning. Meanwhile, no transverse outer snap is to be provided on the transverse outer stretching foot.

As shown in FIG. 12, the transverse inner trim strip 422 not on the transverse keel fixed to the beam 101 comprises a transverse inner decorative edge 4221, the transverse inner decorative extending edges 4222 connected to both ends of the transverse inner decorative edge 4221 and extending in the same direction, and a transverse inner trim strip snap 4223 arranged on the transverse inner decorative edge 4221. The transverse inner trim strip snap 4223 is clamped to the transverse inner snap 3261 on the transverse mounting strips on both sides of the corresponding transverse keel, so that the transverse inner trim strip 422 is fixed to the transverse mounting strip.

As shown in FIG. 12, the transverse inner trim strip 422 on the transverse keel fixed to the beam 101 comprises the transverse inner decorative edge 4221, a transverse inner decorative extending edge 4222 connected to one end of the transverse inner decorative edge 4221, a transverse inner trim strip snap 4223 arranged on the transverse inner decorative edge 4221, and a transverse decorative item inner stopping edge 4224 extending from one end of the transverse inner decorative edge 4221 to the direction of the beam 101. Corresponding to the transverse keel installed to the beam 101, the transverse inner trim strip snap 4223 on its corresponding transverse inner trim strip 422 is clamped to the transverse inner snap 3261 on the same transverse mounting strip and the transverse inner snap on the transverse connecting foot 327.

The transverse inner and outer trim strips and the longitudinal inner and outer trim strips are made of aluminum alloy or plastic.

As shown in FIG. 13, decorative items 5 are provided both outdoors and indoors in positions corresponding to the uprights 102, wherein each decorative item 5 comprises fixed parts 52 and intermediate decorative parts 51 linking the fixed parts 52; the fixed parts 52 are fixed to the longitudinal keels located at both sides of the upright 102; the fixed part 52 located outdoors is stopped or covered by the outer stopping edge of the longitudinal decorative item 5; the fixed part 52 located indoors is stopped or covered by the longitudinal decorative item 5 inner stopping edge 4124; As shown in FIG. 13, the intermediate decorative part 51 is tabular; As shown in FIG. 13, the intermediate decorative part 51 is semicircular or square, or in the shape of a roman column.

As shown in FIG. 14, decorative items 5 are provided both outdoors and indoors in positions corresponding to the uprights, wherein each decorative item 5 comprises fixed parts 62 and intermediate decorative parts 51 linking the fixed parts 62; the fixed parts 62 are fixed to the longitudinal keels located at both sides of the upright 102; the fixed part 52 located outdoors is stopped or covered by the outer stopping edge of the longitudinal decorative item 5; the fixed part 52 located indoors is stopped or covered by the longitudinal decorative item outer stopping edge 4214; the intermediate decorative part 51 is tabular, semicircular or square, or in the shape of a roman column.

The panel unit 2 comprises more than two panels, the outermost panel is stopped by the transverse stopping edge 312 and the longitudinal stopping edge 322, the innermost panel is stopped by the transverse inner trim strip 422 and the longitudinal inner trim strip 412, and there is a gap between adjacent panels. The panel is a glass plate, metal plate, inorganic or organic material plate, and the like. In order to isolate two adjacent panels, the spacing strip 22 fixed to the keel frame is arranged between adjacent panels.

In order to play the role of anti-theft, the grating may be installed between two adjacent panels.

In order to play the role of anti-theft and shock protection, the corrugated plate 23 may be installed between two adjacent panels. Of course, in order to achieve the functions of heat insulation, fire prevention and sound insulation, the heat insulation board, fire prevention board or sound insulation board may be installed between two adjacent panels.

As shown in FIG. 11 and FIG. 12, sealant 81 is provided respectively between the outermost panel and the transverse outer trim strip and between the outermost panel and the longitudinal outer trim strip; sealant 81 is provided between other panels other than the outermost panel, transverse mounting strip and longitudinal mounting strip. For a multilayer panel, sealant 81 is provided at the panel edge, and then a hollow sealed cavity will be formed between adjacent panels. When there is a difference between indoor and outdoor temperatures between indoor and outdoor, no air flow will be formed between indoor and outdoor at the panel unit, thus reducing the heat transfer rate and improve the heat insulation effect, with a cost much lower than that for vacuum glass.

In this embodiment, if in the wall windows need to be installed in the wall, the existing sliding window or casement window may be directly installed in the cell.

The construction method for the above wall is as follows.

(1) Set the keel frames 1 comprising more than two transverse keels 12 and more than two longitudinal keels 11 into a space comprising the uprights 102 and beams 101, fix the upper and lower two transverse keels 12 to the inner side faces of the beams 101, and fix the outermost two longitudinal keels 11 to the inner side faces of the uprights 102; the outer surface of the keel frame 1 is flush with or protrudes from the outer surface of the beam 101; a Cell 13 is formed between adjacent transverse keels 12 and adjacent longitudinal keels 11.

(2) Install the longitudinal mounting strip 31 fixed to and stretching across the longitudinal keel 11 in the Cell 13 in which the panel units 2 needs to be installed; Install the transverse mounting strip fixed to and stretching across the transverse keel 12 in the Cell 13 in which the panel units 2 needs to be installed.

(3) Install the outermost panel in the Cell 13 from indoor to outdoor in the Cell 13 where the single-layered panel needs to be installed, and stop the edge of the outermost panel from the longitudinal stopping edge 312 and the transverse stopping edge 322; then install the spacing strip and inner panel successively until the installation of the panel unit 2 is complete. During installation of the inner panels, sealant 81 is applied to the space between each inner panel and the transverse mounting strip and the space between each inner panel and the longitudinal mounting strip 31 respectively.

(4) Provide the longitudinal inner trim strip 412 clamped to the longitudinal mounting strip 31 in an indoor position corresponding to the longitudinal keel 11, and stop the longitudinal inner trim strip 412 against the panel unit 2; provide the transverse inner trim strip 422 clamped to the transverse mounting strip in an indoor position corresponding to the transverse keel 12, and stop the transverse inner trim strip 422 against the panel unit 2.

(5) Fix the decorative items 5 in outdoor positions corresponding to the uprights 102 and beams 101.

(6) Provide the longitudinal outer trim strip 411 clamped to the longitudinal outer snap 3131 in an outdoor position corresponding to the longitudinal keel 11; provide the transverse outer trim strip 421 clamped to the transverse outer snap 3231 in an outdoor position corresponding to the transverse keel 12.

(7) Apply sealant 81 between the single-layered panel and the longitudinal outer trim strip 411 and between the single-layered panel and the transverse trim strip.

(8) If the windows need to be installed in the wall, the existing sliding window or casement window may be installed in the Cell 13 without the panel unit 2. The sliding window comprises a frame body and glass arranged in the frame body, wherein the frame body is arranged between two adjacent transverse keels 12 through guide rails. The casement window comprises an outer frame body and an inner frame body, wherein the outer frame body is fixed in the cell, and the middle parts at both sides of the inner frame body are interconnected to longitudinal keel 11 at two adjacent sides by a connecting rod.

In this embodiment, due to the provision of the longitudinal extending edge 111 and the transverse extending edge 121, the longitudinal extending edge 111 and the transverse extending edge 121 play a main role of force bearing, and the longitudinal stopping edge 312 and the transverse stopping edge 322 mainly play a role of isolation. In this way, the strength for resisting the panel unit 2 is high, and the panel unit 2 is fixed firmly and reliably. Since the keel frame 1 is wrapped by the longitudinal and transverse mounting strips, longitudinal and transverse outer trim strips 421 and longitudinal and transverse inner trim strips 422, there is no exposed part of the keel frame 1. In this way, the waterproof and dustproof performance for the keel frame 1 is good, and the protection performance for the keel frame 1 is good. Therefore, a low cost, good toughness and good strength iron material may be selected for the keel frame 1 during wall building. In this way, not only the wall strength can be guaranteed, but also the wall cost can be reduced. In addition, in the description, the longitudinal and transverse mounting strips use plastic parts having good heat insulation effect, the longitudinal and transverse outer trim strips 421 are directly clamped to the longitudinal and transverse mounting strips, and the longitudinal and transverse inner trim strips 422 are directly clamped to the longitudinal and transverse mounting strips. In this structure, the longitudinal and transverse mounting strips not only play the role of the fixed panel unit 2 and the fixed inner and outer trim strips, but also play the role of an insulated bridge so that the wall has good heat insulation effect. In this embodiment, either aluminum profile or plastic part is recommended for the inner and outer trim strips. Again, by the provision of the longitudinal and transverse space inside trim strips, on the one hand, the longitudinal and transverse inner trim strips 422 are placed at the junction of keel frame 1 to form an opening, and on the other hand, the purpose of protection of the longitudinal and transverse mounting strips can be achieved, thus increasing the service life of the longitudinal and transverse mounting strips. The wall has the advantage of simple structure and construction method, and therefore, the wall can improve the construction efficiency and reduce the cost.

Embodiment 8

Relative to the embodiment 7, the material selection of the longitudinal and transverse mounting strips herein is not typical at all. In this embodiment 1, the aluminum alloy material is selected for the longitudinal and transverse mounting strips, which results in lower heat insulation performance relative to the embodiment 7. Others are the same as those of the embodiment 7.

Embodiment 9

Relative to the embodiment 8, in order to select the aluminum profile for the longitudinal and transverse mounting strips and improve the heat insulation performance, the outer heat resisting sheet may be arranged between the transverse mounting strip and transverse outer trim strip, a transverse inner heat resisting sheet is arranged between the transverse mounting strip and the transverse inner trim strip; a longitudinal outer heat resisting sheet is arranged between the longitudinal mounting strip and the longitudinal outer trim strip, a longitudinal inner heat resisting sheet is arranged between the longitudinal mounting strip and the longitudinal inner trim strip. Of course, the longitudinal mounting strip and the transverse mounting strip can also be wrapped with a plastic sheet respectively. Others are the same as those of the embodiment 8.

Embodiment 10

In the comparison of embodiment 1, apart from the difference in the longitudinal keels, the transverse keels, the longitudinal mounting strips and the transverse mounting strips, other structures are the same.

Both the longitudinal keel and the transverse keel are in hollow square tube structures.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 11

In the comparison of embodiment 2, apart from the difference in the longitudinal keels, the transverse keels, the longitudinal mounting strips and the transverse mounting strips, other structures are the same.

Both the longitudinal keel and the transverse keel are in hollow square tube structures.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 12

In the comparison of embodiment 3, apart from the difference in the longitudinal keels, the transverse keels, the longitudinal mounting strips and the transverse mounting strips, other structures are the same.

Both the longitudinal keel and the transverse keel are in hollow square tube structures.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 13

In the comparison of embodiment 4, apart from the difference in the longitudinal keels, the transverse keels, the longitudinal mounting strips and the transverse mounting strips, other structures are the same.

Both the longitudinal keel and the transverse keel are in hollow square tube structures.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 14

In the comparison of embodiment 5, apart from the difference in the longitudinal keels, the transverse keels, the longitudinal mounting strips and the transverse mounting strips, other structures are the same.

Both the longitudinal keel and the transverse keel are in hollow square tube structures.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 15

In the comparison of embodiment 6, apart from the difference in the longitudinal keels, the transverse keels, the longitudinal mounting strips and the transverse mounting strips, other structures are the same.

Both the longitudinal keel and the transverse keel are in hollow square tube structures.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 16

In the comparison of embodiment 7, apart from the difference in the longitudinal keels and the transverse keels, other structures are the same.

Both the longitudinal keel and the transverse keel are in hollow square tube structures.

If the provision of the longitudinal outer mounting edge and the transverse outer mounting edge is required, the longitudinal mounting strip and the transverse mounting strip will be different.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 17

In the comparison of embodiment 8, apart from the difference in the longitudinal keels and the transverse keels, other structures are the same.

Both the longitudinal keel and the transverse keel are in hollow square tube structures.

If the provision of the longitudinal outer mounting edge and the transverse outer mounting edge is required, the longitudinal mounting strip and the transverse mounting strip will be different.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Embodiment 18

In the comparison of embodiment 9, apart from the difference in the longitudinal keels and the transverse keels, other structures are the same.

Both the longitudinal keel and the transverse keel are in hollow square tube structures.

If the provision of the longitudinal outer mounting edge and the transverse outer mounting edge is required, the longitudinal mounting strip and the transverse mounting strip will be different.

The longitudinal mounting strip stretches across the longitudinal keel from indoor to outdoor, and the longitudinal mounting strip comprises a longitudinal connecting edge, a longitudinal stopping edge extending from the outer end of the longitudinal connecting edge toward the cell, a longitudinal outer stretching foot extending from the longitudinal stopping edge to the outside, a longitudinal outer mounting edge extending from the longitudinal connecting edge toward the longitudinal keel, a longitudinal inner mounting edge extending from the inner end of the longitudinal connecting edge toward the longitudinal keel, and a longitudinal inner stretching foot extending from the longitudinal inner mounting edge to inside.

The transverse mounting strip stretches across the transverse keel from indoor to outdoor, and the transverse mounting strip comprises a transverse connecting edge, a transverse stopping edge extending from the outer end of the transverse connecting edge toward the cell, a transverse outer stretching foot extending from the transverse stopping edge to the outside, a transverse outer mounting edge extending from the transverse connecting edge toward the transverse keel, a transverse inner mounting edge extending from the inner end of the transverse connecting edge toward the transverse keel, and a transverse inner stretching foot extending from the transverse inner mounting edge to inside.

Singular and plural expression about the English translation of this patent is not accurate. Unless otherwise stated, in general, nouns and pronouns in the patent can be singular, plural also available. If ambiguity occurs, the interpretation of the description, claims and drawings in Chinese shall prevail.

What is claimed is:

1. A wall with one or more of keel frames installed between uprights and floor slabs, comprising:

a plurality of transverse keels a plurality of longitudinal keels;

a plurality of each panel units;

a plurality of transverse mounting strips, arranged between the transverse keels and the panel units, wherein each transverse mounting strip stretches across one end of one corresponding transverse keel, and each of said plurality of transverse mounting strips comprises:

a transverse connecting edge;

a transverse stopping edge extending from a first end of the transverse connecting edge toward the panel unit;

a transverse outer stretching foot extending from the transverse stopping edge;

a transverse inner mounting edge extending from a second end of the transverse connecting edge toward the transverse keel; and a transverse inner stretching foot extending from the transverse inner mounting edge to wrap around the corresponding transverse keel;

a plurality of longitudinal mounting strips arranged between the longitudinal keels and the panel units, wherein each the longitudinal mounting strip stretches across one end of the corresponding longitudinal keel, and each longitudinal mounting strip comprises:

a longitudinal connecting edge;

a longitudinal stopping edge extending from a first end of the longitudinal connecting edge toward the panel unit;

a longitudinal outer stretching foot extending from the longitudinal stopping edge;

a longitudinal inner mounting edge extending from a second end of the longitudinal connecting edge toward the longitudinal keel; and a longitudinal inner stretching foot extending from the longitudinal inner mounting edge to wrap around the corresponding longitudinal keel;

a plurality of transverse outer trim strips, wherein each of said plurality of transverse outer trim strips contacts with one corresponding transverse outer stretching foot;

a plurality of transverse inner trim strips, wherein each of said plurality of transverse inner trim strips contacting with one corresponding transverse inner stretching foot;

a plurality of longitudinal outer trim strips, wherein each of said plurality of longitudinal outer trim strips contacts with one corresponding longitudinal outer stretching foot;

a plurality of longitudinal inner trim strips, wherein each of said plurality of longitudinal inner trim strips contacts with one corresponding longitudinal inner stretching foot; and decorative items;

wherein each transverse inner mounting edge contacts with one corresponding transverse keel, and is fixed to the corresponding transverse keel;

wherein each longitudinal inner mounting edge contacts with one corresponding longitudinal keel, and is fixed to the corresponding longitudinal keel; and wherein each panel unit is installed onto one corresponding transverse mounting strip and stopped by one corresponding transverse stopping edge.

2. The wall according to claim 1, wherein the transverse keel further comprises a transverse extending edge extending toward the panel unit, and the transverse stopping edge contacts with the transverse extending edge; and the longitudinal keel further comprises a longitudinal extending edge extending toward the panel unit, and the longitudinal stopping edge contacts with the longitudinal extending edge.

3. The wall according to claim 1, further comprising:

a transverse outer heat resisting sheet arranged between the transverse mounting strip and the transverse outer trim strip;

a transverse inner heat resisting sheet is arranged between the transverse mounting strip and the transverse inner trim strip;

a longitudinal outer heat resisting sheet is arranged between the longitudinal mounting strip and the longitudinal outer trim strip; and a longitudinal inner heat resisting sheet is arranged between the longitudinal mounting strip and the longitudinal inner trim strip.

4. The wall according to claim 1, wherein the transverse mounting strip further comprises a transverse outer mounting edge fixed to the transverse keel; and the longitudinal mounting strip further comprises a longitudinal outer mounting edge fixed to the longitudinal keel.

5. The wall according to claim 1, further comprising:

a transverse outer snap arranged on the transverse outer stretching foot;

a transverse outer trim strip snap arranged on the transverse outer trim strip;

a transverse inner snap arranged on the transverse inner stretching foot;

a transverse inner trim strip snap arranged on the transverse inner trim strip;

a longitudinal outer snap arranged on the longitudinal outer stretching foot;

a longitudinal outer trim strip snap arranged on the longitudinal outer trim strip;

a longitudinal inner snap arranged on the longitudinal inner stretching foot; and a longitudinal inner trim strip snap arranged on the longitudinal inner trim strip; and wherein the transverse outer trim strip snap and the transverse outer snap are clamped to each other.

6. The wall according to claim 1, further comprising:

a transverse projection arranged in a middle part of an inner side of the transverse outer trim strip; and transverse screws for fastening the transverse projection onto the transverse keel;

a transverse inner snap arranged on the transverse inner stretching foot;

a transverse inner trim strip snap arranged on the transverse inner trim strip, wherein the transverse inner trim strip snap and the transverse inner snap are clamped to each other;

a transverse projection arranged in a middle part of an inner side of the longitudinal outer trim strip;

longitudinal screws for fastening the longitudinal projection onto the longitudinal keel;

a longitudinal inner snap arranged on the longitudinal inner stretching foot; and a longitudinal inner trim strip snap is arranged on the longitudinal inner trim strip, wherein the longitudinal inner trim strip snap and the longitudinal inner snap are clamped to each other.

7. The wall according to claim 6, further comprising:

a transverse outer positioning strip arranged at an inner side of the transverse outer trim strip, located at an inner side of the transverse outer stretching foot, and contacting with the transverse outer stretching foot; and a longitudinal outer positioning strip arranged at an inner side face of the longitudinal outer trim strip, located at an inner side of the longitudinal outer stretching foot, and contacting with the longitudinal outer stretching foot.

8. The wall according to claim 1, wherein the inside surface of the transverse outer trim strip is flush with or far away from an outer surface of the transverse keels or the longitudinal keels;

the transverse inner trim strip is flush with or far away from an inside surface of the transverse keels or the longitudinal keels;

the longitudinal outer trim strip is flush with or far away from the outer surface of the transverse keels or the longitudinal keels; and the longitudinal inner trim strip is flush with or far away from the inside surface of the transverse keels or the longitudinal keels.

9. The wall according to claim 4, wherein the transverse outer mounting edge is fixed to the transverse keel connected with beams, and stretches to the transverse connecting foot;

the transverse outer snap is arranged on the transverse connecting foot;

the transverse outer trim strip is clamped on a corresponding transverse connecting foot and a corresponding transverse outer stretching foot;

the transverse outer snap is clamped to the transverse outer trim strip snap;

the longitudinal outer mounting edge is fixed to the longitudinal keel connected with the uprights, and stretches to the longitudinal connecting foot;

the longitudinal outer snap is arranged on the longitudinal connecting foot;

the longitudinal outer trim strip is clamped on a corresponding longitudinal connecting foot and a corresponding longitudinal outer stretching foot; and the longitudinal outer snap is clamped to the longitudinal outer trim strip snap.

10. The wall according to claim 1, wherein the said panel unit is a single-layered panel stopped by the transverse stopping edge and the longitudinal stopping edge.

11. The wall according to claim 10, further comprising:

a transverse space inside trim strip, installed between two adjacent longitudinal keels and on the transverse mounting strip, wherein the transverse space inside trim strip contacts with the single-layered panel, and a middle part of the transverse space inside trim strip contacts with the transverse inner trim strip;

a longitudinal space inside trim strip, installed between two adjacent transverse keels and on the longitudinal mounting strip, wherein the longitudinal space inside trim strip contacts with the single-layered panel, and the middle part of the transverse space inside trim strip contacts with the longitudinal inner trim strip.

12. The wall according to claim 10, wherein the said transverse space inside trim strip comprises:

a transverse trim part;

a transverse bent part; and a transverse fixed part;

wherein the transverse bent part is connected between the transverse trim part and the transverse fixed part, the transverse bent part extends from one end of the transverse trim part to the transverse keel in a bending manner, the inner end of the transverse trim part contacts with the transverse inner trim strip, and the transverse fixed part is fixed to the transverse mounting strip, the said longitudinal space inside trim strip comprises:

a longitudinal trim part;

a longitudinal bent part; and a longitudinal fixed part;

wherein the longitudinal bent part is connected between the longitudinal trim part and the longitudinal fixed part, the longitudinal bent part extends from one end of the longitudinal trim part to the longitudinal keel in a bending manner; the inner end of the longitudinal trim part contacts with the longitudinal inner trim strip, and the longitudinal fixed part is fixed to the longitudinal mounting strip.

13. The wall according to claim 12, wherein the transverse trim part is connected with a transverse rod contacting with the transverse mounting strip;

the longitudinal trim part is connected with a longitudinal rod contacting with the longitudinal mounting strip.

14. The wall according to claim 12, wherein the inner end of the transverse trim part extends to the transverse inner trim strip;

the inner end of the longitudinal trim part extends to the longitudinal inner trim strip.

15. The wall according to claim 10, wherein sealant is provided between the single-layered panel and the transverse outer trim strip, between the single-layered panel and the longitudinal outer trim strip, between the single-layered panel and the transverse mounting strip, between the single-layered panel and the longitudinal mounting strip.

16. The wall according to claim 10, wherein the transverse inner mounting edge extends to the transverse inner trim strip;

a longitudinal inner decorative edge extends to the longitudinal inner trim strip.

17. The wall according to claim 1, wherein each panel unit comprises more than two panels, an outermost panel is stopped by the transverse stopping edge and the longitudinal stopping edge, an innermost panel is stopped by the transverse inner trim strip and the transverse outer trim strip, and a gap exists between adjacent panels.

18. The wall according to claim 17, further comprising:

a spacing strip or an anti-theft grating or a corrugated plate or a heat insulation board fixed to the transverse keel or the longitudinal keel and arranged between adjacent panel units.

19. The wall according to claim 1, wherein the transverse keels or the longitudinal keels protrudes from an outer surface of beams.

20. The wall according to claim 1, wherein said decorative items comprise fixed parts and an intermediate decorative part connected between the fixed parts, the said intermediate decorative part is tabular, semicircular or square or in the shape of a roman column.

21. A wall construction method, comprising:

(1) setting a plurality of transverse keels and a plurality of longitudinal keels into a space comprising the uprights and beams by fixing upper and lower two transverse keels to inner side faces of the beams, fixing outermost two longitudinal keels to inner side faces of the uprights, wherein the outer surface of the transverse keels and longitudinal keels are flush with or protrudes from outer surface of the beams, a cell is formed between adjacent transverse keels and adjacent longitudinal keels;

(2) installing a transverse mounting strip onto and stretching across the transverse keel in the cell where the panel units needs to be installed installing the longitudinal mounting strip onto and stretching across the longitudinal keel in the cell where the panel units needs to be installed, wherein the transverse mounting strip comprises a transverse connecting edge, a transverse stopping edge extending from the transverse connecting edge toward the cell, a transverse outer stretching foot extending from the transverse stopping edge, a transverse inner mounting edge extending from the transverse connecting edge toward the transverse keel, and a transverse inner stretching foot extending from the transverse inner mounting edge to inside, and the transverse inner mounting edge is fixed onto the transverse keel, the longitudinal mounting strip comprises a longitudinal connecting edge, a longitudinal stopping edge extending from the longitudinal connecting edge toward the cell, a longitudinal outer stretching foot extending from the longitudinal stopping edge, a longitudinal inner mounting edge extending from the longitudinal connecting edge toward the longitudinal keel, and a longitudinal inner stretching foot extending from the longitudinal inner mounting edge, the longitudinal inner mounting edge is fixed onto the longitudinal keel;

(3) installing the panel unit in the cell, which outer edges of the panel unit are stopped by the transverse stopping edges and the longitudinal stopping edges applying sealant respectively to space between the panel unit and the transverse mounting strips and space between the panel unit and the longitudinal mounting strips;

(4) clamping the transverse inner trim strip onto the transverse inner stretching foot corresponding to the transverse keel, clamping the longitudinal inner trim strip onto the longitudinal inner stretching foot corresponding to the longitudinal keel;

(5) fixing decorative items onto the uprights and beams;

(6) setting the transverse outer trim strip onto the transverse outer stretching foot corresponding to the transverse keel setting the longitudinal outer trim strip onto the longitudinal outer stretching foot corresponding to the longitudinal keel.

22. The wall construction method of according to claim 21, wherein the transverse keel extends to form a transverse extending edge toward the panel unit;

the transverse stopping edge contacts with the transverse extending edge and is located at an inner side of the transverse extending edge when the transverse mounting strips have been installed;

the longitudinal keel extends to form longitudinal extending edge toward the unit panel; and the longitudinal stopping edge contacts with the longitudinal extending edge and is located at an inner side of the longitudinal extending edge when the longitudinal mounting strips have been installed.

23. The wall construction method according to claim 21, wherein the transverse mounting strip further comprises a transverse outer mounting edges, and the transverse outer mounting edges are fixed to the transverse keel while the transverse outer mounting edges are being installed; and the longitudinal mounting strip further comprises longitudinal outer mounting edges, and the longitudinal outer mounting edges are fixed to the longitudinal keel while the longitudinal outer mounting edges are being installed.

24. The wall construction method according to claim 21, further comprising:

a transverse outer snap arranged on the transverse outer stretching foot, a transverse outer trim strip snap arranged on the transverse outer trim strip;

a transverse inner snap arranged on the transverse inner stretching foot;

a transverse inner trim strip snap arranged on the transverse inner trim strip;

a longitudinal outer snap arranged on the longitudinal outer stretching foot;

a longitudinal outer trim strip snap arranged on the longitudinal outer trim strip;

a longitudinal inner snap arranged on the longitudinal inner stretching foot;

a longitudinal inner trim strip snap arranged on the longitudinal inner trim strip; and wherein the transverse outer trim strip snap and the transverse outer snap are clamped to each other.

* * * * *